US008261480B2

(12) United States Patent
Hall et al.

(10) Patent No.: US 8,261,480 B2
(45) Date of Patent: Sep. 11, 2012

(54) RIGID COMPOSITE STRUCTURE WITH A SUPERHARD INTERIOR SURFACE

(76) Inventors: David R. Hall, Provo, UT (US); Scott Dahlgren, Alpine, UT (US); Ronald Crockett, Payson, UT (US); Timothy C. Duke, Provo, UT (US); Joshua Sensinger, Spanish Fork, UT (US); Joe Fox, Spanish Fork, UT (US); Tyson J. Wilde, Spanish Fork, UT (US)

( * ) Notice: Subject to any disclaimer, the term of this patent is extended or adjusted under 35 U.S.C. 154(b) by 0 days.

(21) Appl. No.: 13/211,154

(22) Filed: Aug. 16, 2011

(65) Prior Publication Data

US 2011/0296730 A1 Dec. 8, 2011

Related U.S. Application Data

(63) Continuation of application No. 12/846,794, filed on Jul. 29, 2010, now Pat. No. 8,020,333, which is a continuation of application No. 11/381,709, filed on May 4, 2006, now abandoned.

(51) Int. Cl.
*F41A 21/02* (2006.01)

(52) U.S. Cl. ..... 42/76.02; 42/76.01; 42/78; 89/14.05; 89/14.7; 89/16

(58) Field of Classification Search ..... 42/76.02, 42/76.01, 77, 78, 76.1; 89/14.05, 16, 14.7, 89/29

See application file for complete search history.

(56) References Cited

U.S. PATENT DOCUMENTS 2,170,259 A 8/1939 Heinrich
2,850,828 A 9/1958 Sullivan
2,915,946 A 12/1959 Marden
2,975,677 A 3/1961 Kelly
2,977,666 A 4/1961 Brace
3,025,765 A 3/1962 Baker
3,571,962 A 3/1971 Eig
3,753,694 A 8/1973 Badia
4,411,672 A 10/1983 Ishizuka
4,435,455 A 3/1984 Prewo
4,485,721 A 12/1984 Shankhla
4,525,178 A 6/1985 Hall
4,577,431 A 3/1986 Siemers
4,669,212 A 6/1987 Jackson
4,753,154 A 6/1988 Higashi
4,841,836 A 6/1989 Bundy
4,982,648 A 1/1991 Bol
5,160,802 A 11/1992 Moscrip
5,183,958 A 2/1993 Petrovich
5,196,637 A 3/1993 Petrovich
5,212,328 A 5/1993 Petrovich
5,378,499 A 1/1995 Martin
5,462,772 A 10/1995 Lemelson
5,600,912 A 2/1997 Smith
5,657,568 A 8/1997 Christensen
5,731,046 A 3/1998 Mistry
5,804,756 A 9/1998 Christensen
5,856,631 A 1/1999 Julien
5,915,937 A 6/1999 Christensen (Continued)

*Primary Examiner* — Jonathan C Weber
(74) *Attorney, Agent, or Firm* — Philip W. Townsend, III

(57) ABSTRACT

A rigid composite structure has a bore formed in a metallic material and a super hard interior segment or segments disposed within the bore. Each segment may be lined adjacent to one another and held under compression within the bore. The segments may be made of super hard materials such as natural diamond, synthetic diamond, polycrystalline diamond, single crystalline diamond, cubic boron nitrate or other superhard composite materials which exhibit low thermal expansion rates and are generally chemically inert. The resultant rigid composite structure may possess higher tolerances to high pressures and high temperatures.

11 Claims, 22 Drawing Sheets

U.S. PATENT DOCUMENTS

| | | | |
|---|---|---|---|
| 6,482,248 | B1 | 11/2002 | Holloway |
| 6,576,598 | B2 | 6/2003 | Brown |
| 6,615,702 | B1 | 9/2003 | Julien |
| 6,789,454 | B2 | 9/2004 | Smith |
| 6,817,550 | B2 | 11/2004 | Taylor |
| 7,172,142 | B2 | 2/2007 | Taylor |
| 7,197,986 | B1 | 4/2007 | Calkins |
| 7,347,259 | B2 | 3/2008 | Ravensbergen |
| 2002/0002786 | A1 | 1/2002 | Smith |
| 2003/0078170 | A1 | 4/2003 | Brown |
| 2004/0052964 | A1 | 3/2004 | Kaufmann |
| 2004/0140292 | A1 | 7/2004 | Kelley |
| 2005/0268517 | A1 | 12/2005 | Withers |
| 2006/0265926 | A1 | 11/2006 | Sietsema |

RIGID COMPOSITE STRUCTURE WITH A SUPERHARD INTERIOR SURFACE

CROSS REFERENCE TO RELATED APPLICATION

This application is a continuation of U.S. patent application Ser. No. 12/846,794 filed on Jul. 29, 2010, now U.S. Pat. No. 8,020,333 and titled Cylinder with Polycrystalline Diamond Interior. U.S. patent application Ser. No. 12/846,794 was a continuation of U.S. patent application Ser. No. 11/381,709, filed on May 4, 2006, which is now abandoned. Both of these references are herein incorporated by reference for all that they contain.

BACKGROUND OF THE INVENTION

This invention relates to composite structures that retain their structural integrity despite exposure to the wear erosive and/or corrosive effects of sudden high pressures, high-pressure friction forces and high temperatures typically associated with their use, particularly within the interior of the structure. The present invention may be especially adapted for use in gun barrels, piston cylinders, pipes or other composite structures where the retention of structural integrity despite exposure to such brisant forces is an integral component of their ordinary application.

Gun barrels for example, are structures that have typically been constructed of metallic materials that are incorporated to accommodate a projectile or bullet that may then be propelled out of the barrel as a result of an exploding cartridge in the breech end of the structure. During this firing process, brisant forces, including high pressure and elevated temperatures, resulting from the hot gases released from the cartridge and friction and distortion energy created between the bullet and internal circumference of the barrel, are suddenly exerted on the barrel as the bullet travels along and out of the barrel. Gun barrels that are consistently exposed to these brisant forces, such as machine gun barrels that expend hundreds of rounds per minute, are more prone to losing their original structural integrity as the metallic material begins to expand and warp as a result of elevated temperatures exerted on the barrel or the barrel becomes clogged with an accumulation of lead and/or copper that breaks away from projectiles as they exit the barrel. This is of particular concern in gun barrels where the diameter of the barrel expands such that the internal circumference of the barrel no longer holds enough compression to effectively launch a projectile, or the projectile falls short of the desired distance, rendering the gun ineffective. Alternatively, gun barrels have also been known to explode and cause physical injury or death to their operators as a result of deformed, warped or clogged barrels. These concerns have become increasingly significant as advancements have been made in ballistics which have produced higher powered propellants, higher muzzle velocity, higher rates of fire and so forth, making the probability of these phenomena more likely.

In response to these phenomena, many attempts have been made to produce barrels made of tough, high strength materials that can accommodate such advancements and are capable of withstanding the detrimental effects of sudden high pressures and temperatures normally associated in ordinance use. Despite concerted efforts, many of these developments have yet to prove effective in their application because materials that yield high strength characteristics may conversely have very low toughness properties making the barrel brittle and more susceptible to breaking or exploding, while materials that exhibit high toughness properties may conversely exhibit low hardness making them more susceptible to erosion.

BRIEF SUMMARY OF THE INVENTION

The present invention is a rigid composite structure that is resistant to wear and able to retain its structural integrity when exposed to high temperatures and high pressures. This is achieved through the incorporation of high strength, high toughness crystalline materials and their subsequent structural arrangement. The structural arrangement and selected materials used serve to enhance the structures low co-efficient of thermal expansion, low friction refractory, high hardness, and chemical inert properties which in turn provide better retention of structural integrity and resistance to wear.

The invention comprises a bore formed in a metallic material. The metallic material may comprise of one or more of the following materials: aluminum, titanium, a refractory metal, steel, stainless steel, Invar 36, Invar 42, Invar 365, a composite, a ceramic, carbon fiber or combinations thereof. In some embodiments, the metallic material may exhibit a low coefficient of thermal expansion. The bore forms a longitudinal axis and encases a super hard geometric segment or segments. The metallic material assists to support the segments structurally and may also be shrink wrapped around the segments to hold them under compression.

The super hard geometric segment or segments may be arranged co-axially adjacent one another along the longitudinal axis and within the bore. The segment or segments may comprise natural diamond, synthetic diamond, polycrystalline diamond, single crystalline diamond, cubic boron nitride or composite materials. These materials may have low thermal expansion characteristics and are typically chemically inert which further enhances the structure's ability to retain its structural integrity. The segment or segments may remain in place within the bore being interposed between both a shoulder and biased end of the bore or by brazing each segment together. The brazed material may comprise gold, silver, a refractory metal, carbide, tungsten carbide, niobium, titanium, platinum, molybdenum, Nickel Paladiium, cadmium, cobalt, chromium, copper, silicon, Zinc, lead, Manganese, tungsten, platinum or combinations thereof. Alternatively, the segments may be held in place by shrink wrapping the metallic material around the segments such that the segments are held under radial compression within the bore and axial compression along the bore.

An intermediate material may serve as a transition layer between the metallic material and the segments. The intermediate material may comprise Invar 36, Invar 42, Invar 365, a composite, a ceramic, a refractory metal, carbon fiber or combinations thereof. The transition layer may also serve as a thermal insulator when wrapped in between the metallic material and the segments to reduce thermal expansion of the metallic material and assist in maintaining the structural integrity of the composite structure. In order to promote metallurgical bonding between the metallic material and the segments, as well as the intermediate material, a binder may be used. The binder may comprise cobalt, nickel, iron, tungsten, tantalum, molybdenum, silicon, niobium, titanium, zirconium, a refractory group metal or combinations thereof.

This new composite structure is capable of withstanding hot, highly corrosive environments while at the same time also being capable of withstanding substantial pressure and structural stresses as a result of continued use and friction.

DETAILED DESCRIPTION OF THE INVENTION AND THE PREFERRED EMBODIMENT

It will be readily understood that the components of the present invention, as generally described and illustrated in the Figures herein, may be arranged and designed in a wide variety of different configurations. Thus, the following, more detailed description of embodiments of the apparatus of the present invention, as represented in the Figures is not intended to limit the scope of the invention, as claimed, but is merely representative of various selected embodiments of the invention.

The illustrated embodiments of the invention will best be understood by reference to the drawings, wherein like parts are designated by like numerals throughout. Those of ordinary skill in the art will, of course, appreciate that various modifications to the apparatus described herein may easily be made without departing from the essential characteristics of the invention, as described in connection with the Figures. Thus, the following description of the Figures is intended only by way of example, and simply illustrates certain selected embodiments consistent with the invention as claimed herein.

Figure 1:
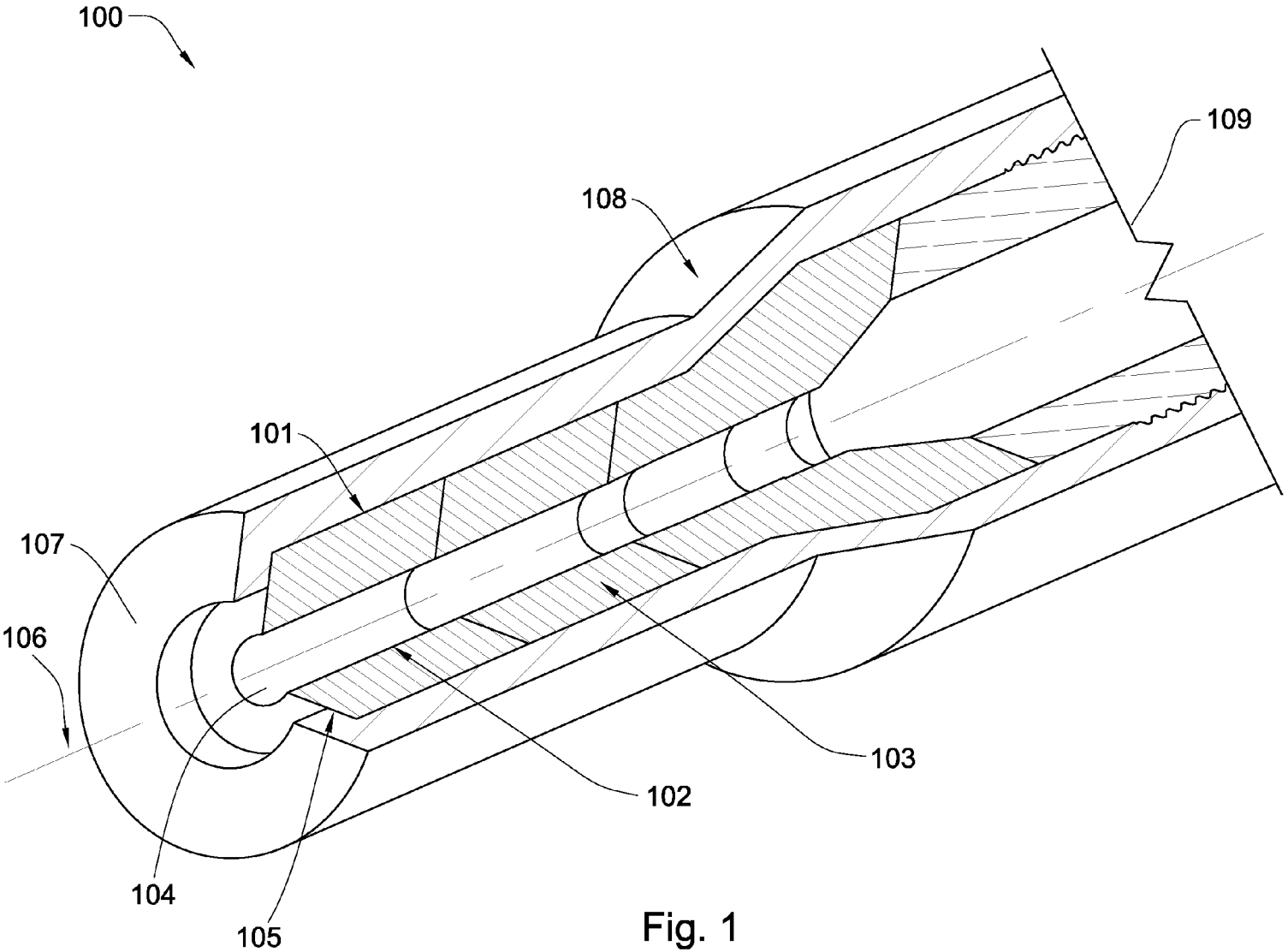
FIG. 1 is a perspective sectional diagram of an embodiment of a rigid composite structure in accordance with the present invention broken away to indicate an indeterminate length.
Figure 2:
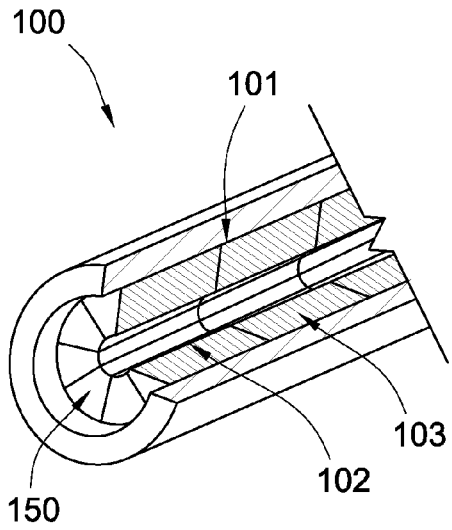
FIG. 2 is a perspective sectional diagram of another embodiment depicting a configuration of the super hard segments.
Figure 3:
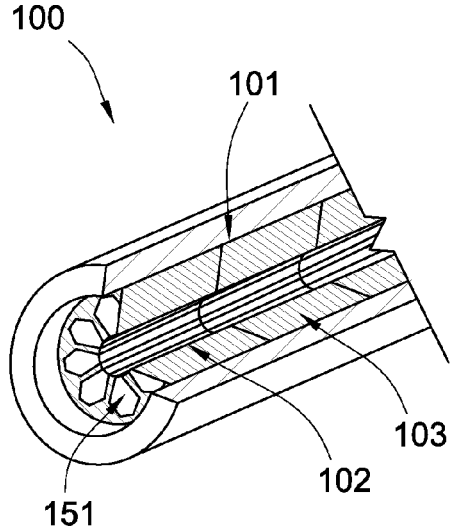
FIG. 3 is a perspective sectional diagram of another embodiment depicting a configuration of the super hard segments.
Figure 4:
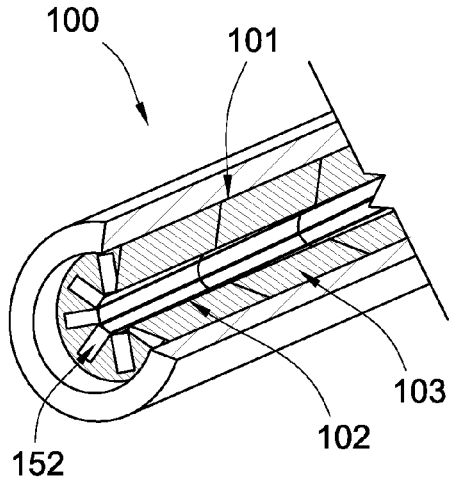
FIG. 4 is a perspective sectional diagram of another embodiment depicting a configuration of the super hard segments.
Figure 5:
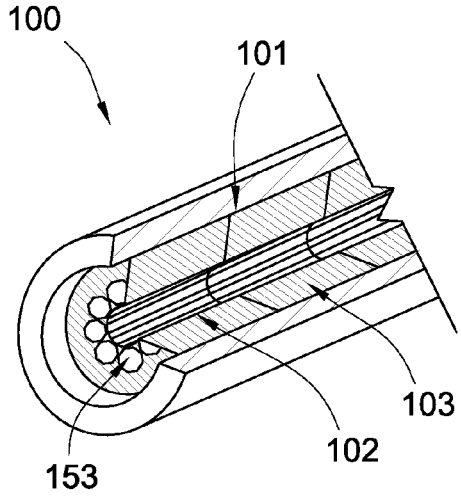
FIG. 5 is a perspective sectional diagram of another embodiment depicting a configuration of the super hard segments.

FIG. 1 is a diagram of an embodiment of a rigid composite structure 100 in accordance with the present invention. The rigid composite structure 100 may comprise a first bore 101 formed in a metallic material and forming a longitudinal axis 106 that is substantially coaxial with a second bore 102. The second bore may be formed in at least one super hard geometric segment 103 disposed within the first bore. A plurality of annular super hard composite segments may be interposed adjacent one another co-axially along the longitudinal axis 106 of the first bore 101. The interior surface of the segments may be polished to provide a low friction surface as well.

A significant feature of this invention is the second bore 102 which may be formed in super hard geometric segments 103 which have a super hard interior surface 104. The surface may comprise a suitable composite material including but not limited to natural diamond, synthetic diamond, polycrystalline diamond, single crystalline diamond, or cubic boron nitride. This super hard composite material may also incorporate a binder material comprising of cobalt, niobium, titanium, zirconium, nickel, iron, tungsten, tantalum, molybdenum, silicon, a refractory group metal or combinations thereof which may bind together grains of the super hard composite materials in such a way to form the segments. The interior portion of the segments may thus comprise a region depleted of the binder material. This may be advantageous when the second bore 102 is subjected to high temperatures since the binder material may have a higher thermal expansion rate than the superhard composite material. The super hard geometric segments 103, which may be annular segments, wedge like segments, various geometric shape segments or a combination thereof, may be interposed within the first bore 101 in a concentric array that extend lengthwise along the longitudinal axis 106 of the first bore 101. The super hard composite material may be chemically inert and may possess fracture toughness, thermal shock resistance, tensile strength, and low thermal expansion characteristics all of which may serve to further enhance resistance to wear when high pressures or high temperatures are exerted on the interior surface 104 of the structure. While not limited thereto, polycrystalline diamond may be the preferred composite material and may possess a plurality of grains comprised of a size of 0.1 to 300 microns. The super hard composite material may also have a thermal expansion coefficient of approximately 2 μin/in, but in some embodiments, the thermal expansion coefficient may be 0.1 to 10 μin/in. This is a significant feature as it enhances the structural integrity of the overall structure during periods of high pressure and high temperatures in such applications as a gun barrel, piston cylinder, pipe, tube, or other rigid composite structures that may exert friction on the interior surface. Despite the various forces that may act on the super hard interior surface 104, the second bore 102 is able to retain its structural integrity due in part to the inherent characteristics of the super hard geometric segments 103 disposed within the first bore 101.

The metallic material may comprises a suitable material that exhibits lower coefficients of thermal expansion at lower temperatures and higher coefficients of thermal expansion at higher temperatures such as Invar 365. Other suitable metallic materials that may be used include but are not limited to aluminum, titanium, a refractory metal, steel, stainless steel, Invar 36, Invar 42, a composite, a ceramic, carbon fiber or combinations thereof. These materials may exhibit such characteristics that allow the metallic material to be manipulated under high temperature and then shrink wrapped around the super hard geometric segments 103. This process may be used in order to hold the super hard geometric segments 103 under radial compression of 50-200 % of operating pressure and axial compression of 50-200 % of proof pressure being achieved through incorporation of a shoulder 105 at the first end 107 of the first bore 101 and biasing unit 108 at the second end 109. Although not limited to, the metallic material may be Invar 365 due to its comparative characteristics with polycrystalline diamond which allow both the metallic material and super hard geometric segments 103 to complement one another in their utility and to further enhance the structures ability to retain its structural integrity during periods of high pressures and high temperatures.

Although the thickness of the super hard composite material may be comparable to the thickness of the metallic material, it should be noted that in embodiments where the structure comprises a gun barrel, the preferred thickness for the super hard composite material is 0.040 inches to 0.25 inches, while the thickness of the metallic material is 0.25 inches to 0.75 inches. The thicknesses of the materials depends on many factors and any combinations of thickness are covered within the scope of the claims.

FIGS. 2-5 depict various configurations of the super hard geometric segments 103 that may comprise natural diamond, synthetic diamond, polycrystalline diamond, single crystalline diamond, or cubic boron nitride that may also incorporate a binder material of cobalt, niobium, titanium, zirconium, a refractory group metal or combinations thereof. Each segment may comprise a substantially annular shape, a substantially wedge shape, a substantially circular or semi-circular shape, substantially curved shape 150, a substantially hexagonal shape 151, a substantially rectangular shape 152, a substantially trapezoidal shape, or a substantially octagonal shape 153.

Figure 6:
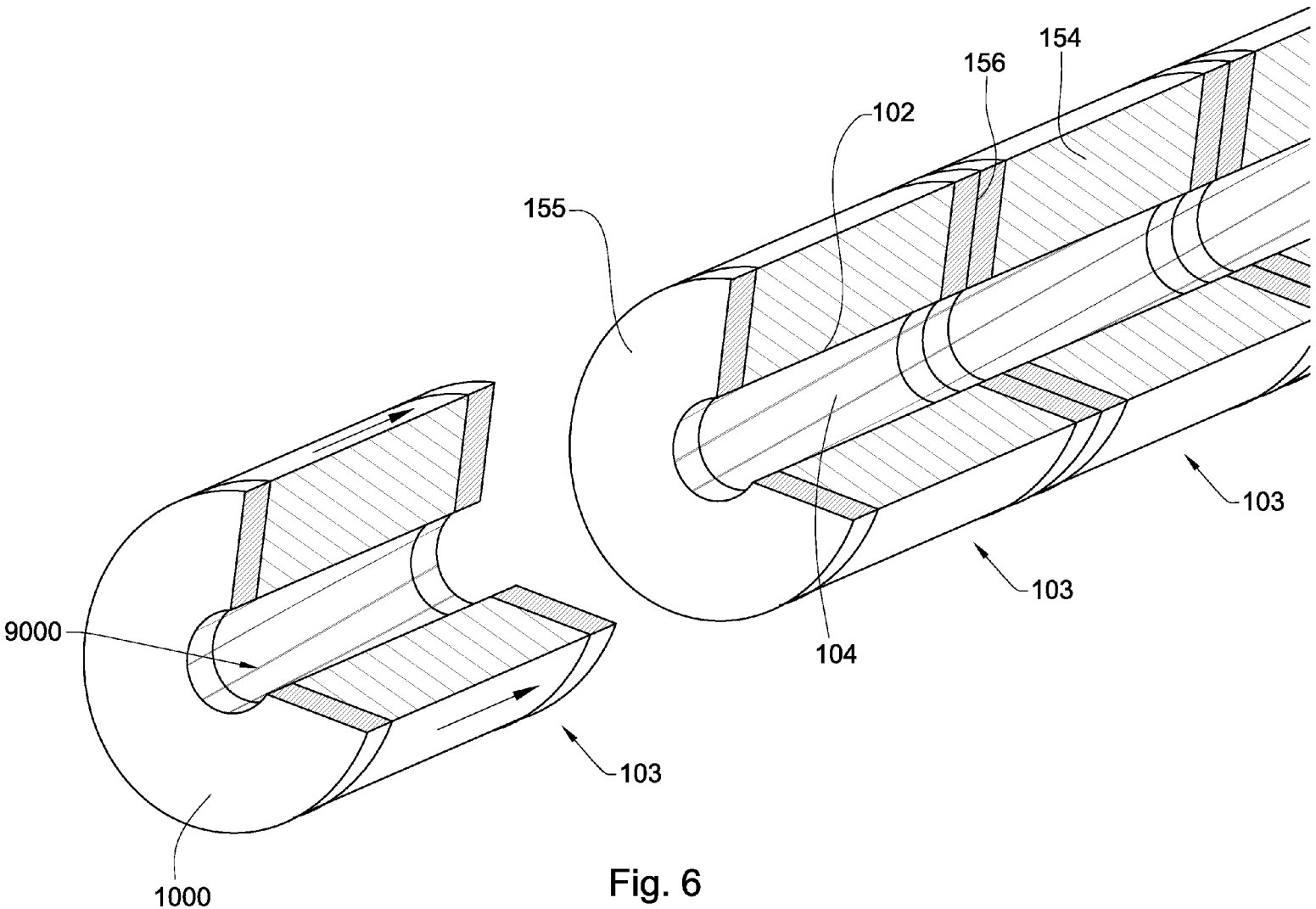
FIG. 6 is a perspective sectional diagram of another embodiment depicting a configuration for brazing segment interfaces.
Figure 7:
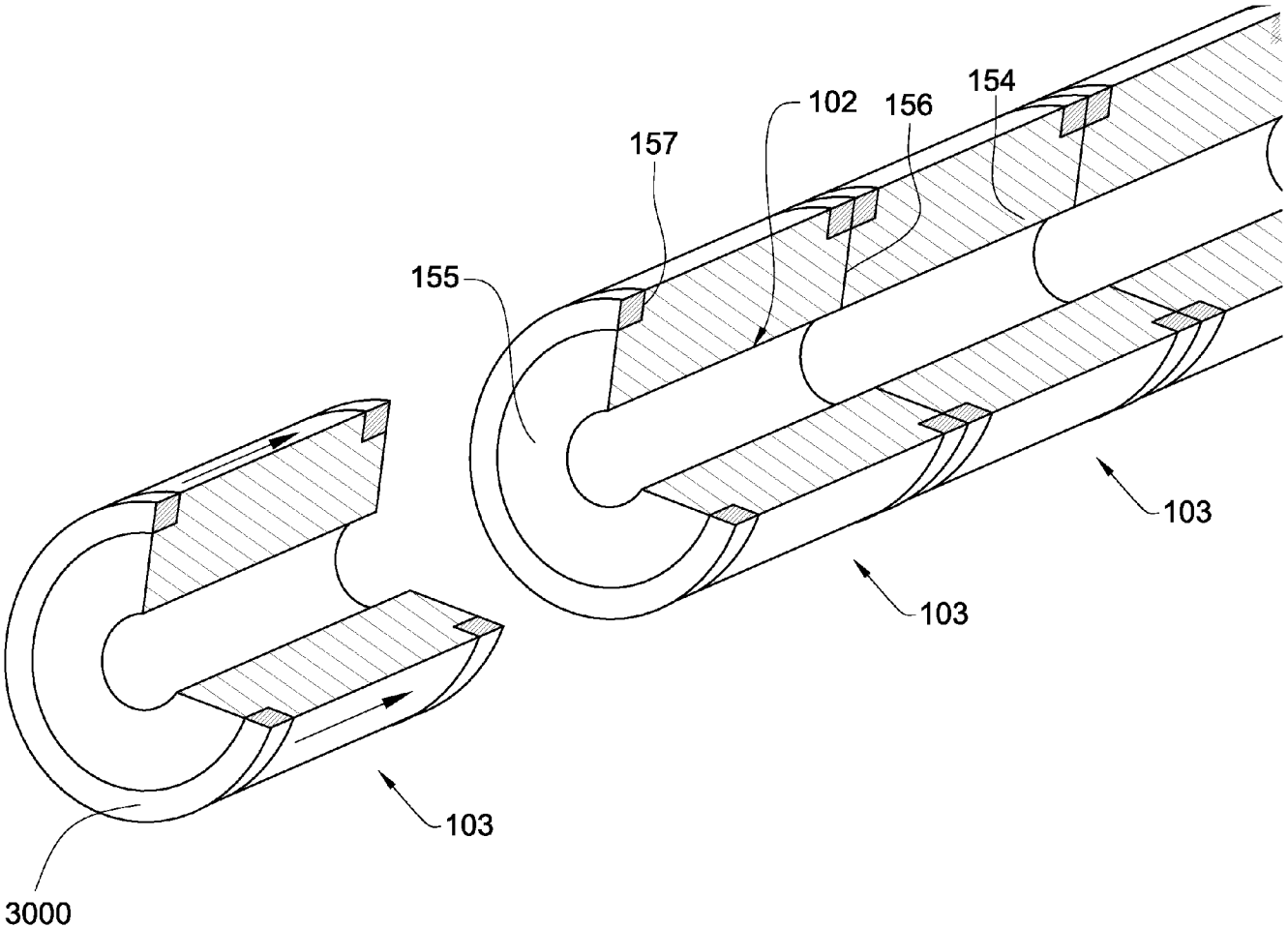
FIG. 7 is a perspective sectional diagram of another embodiment depicting another configuration for brazing segment interfaces.
Figure 8:
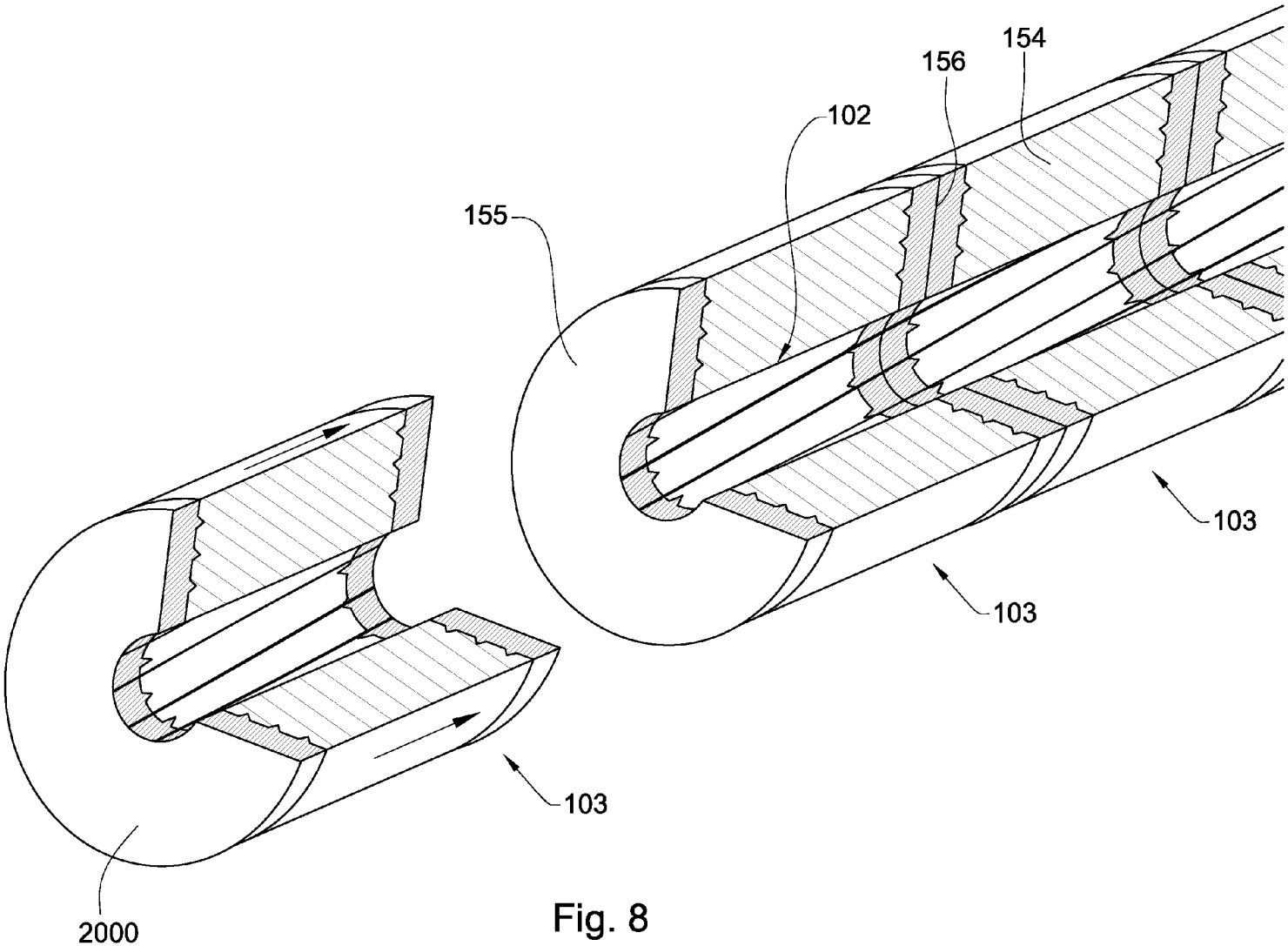
FIG. 8 is a perspective sectional diagram of another embodiment depicting another configuration for brazing segment interfaces.

In a preferred method for manufacturing super hard geometric segments 103, diamond or cubic boron nitride grains are sintered in a high temperature high pressure press to form the desired shape of the segment. Usually a binder material is used to catalyze the sintering process, a preferred binder material being cobalt, which diffuses under the high pressure and temperature from adjacent material (typically tungsten carbide) also in the press. In such a method, a bond will form between the adjacent tungsten carbide and the sintered diamond. FIGS. 6-8 depict the processes whereby the segments may be connected and held in place. Referring to FIG. 6, the super hard geometric segments 103 are brazed together using an interfacing material 154 that may comprise of gold, silver, a refractory metal, carbide, tungsten carbide, a cemented metal carbide, niobium, titanium, platinum, molybdenum or combinations thereof Preferably, the interfacing material 154 is a tungsten carbide that has bonded to the super hard segment during sintering. The abutting ends 155 and 156, may be formed while still in the press. In FIG. 6, the abutting ends 155, 156 comprise a flat shape 1000. In some embodiments a pattern 9000 may be formed in the interior surface 104 of the segments while still in the press, such as the rifling patterns for embodiments where the structure comprises a gun barrel. FIG. 7 discloses an interfacing material 154 comprising an annular shape 3000. The annular shape 3000 is bonded in a recess area 157 formed in the abutting ends 155 and 156 of the segments 103. The segments may then be brazed together using the interfacing materials adjacent the abutting end of the segments. In some embodiments, the segments may be heat treated or annealed during and/or after they are brazed together, which may be advantageous since stresses created by brazing may be reduce or eliminated from the interior surface 104. In some embodiments the segments may be annealed or heat treated after being formed in the press. In embodiments, where a projectile or bullet is propelled through the structure, the presence of a solid braze between interfacing materials 154 may increase friction. Also the interfacing material 154 may thermally expand faster than the super hard geometric segments 103 which may create stress in the interior surface 104 if an interfacing material is present. FIG. 8 discloses a non-planar interface 2000 between the abutting end 155 and the interfacing material 154.

Figure 9:
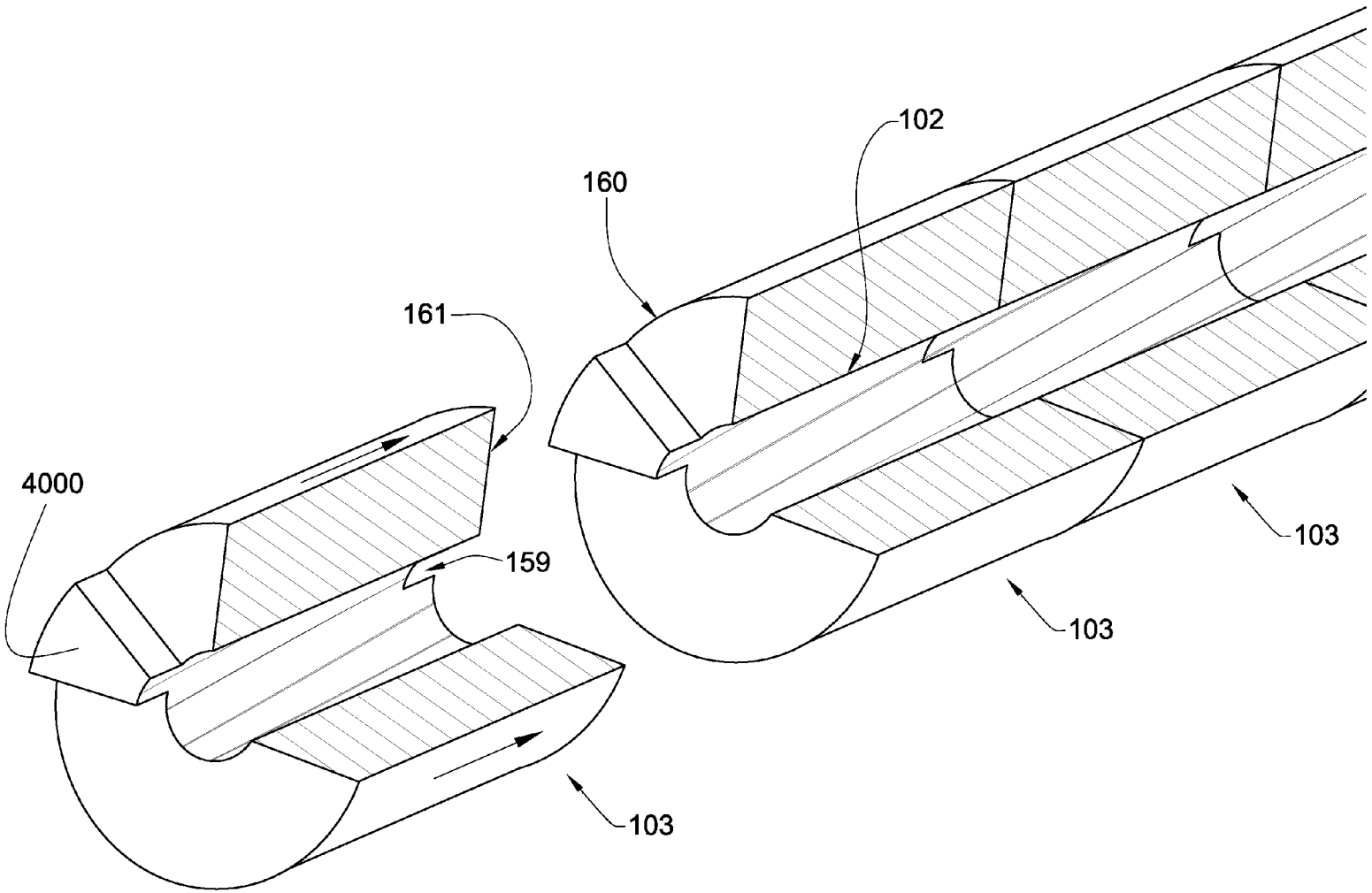
FIG. 9 is a perspective sectional diagram of another embodiment depicting interlocking configured segments.

FIG. 9 is a diagram of another embodiment of the present invention whereby the segments 103 may be configured in such a way that they are joined by interlocking profiles. A first abutting end 160 may comprise a protrusion 4000, which may be fitted within a socket 159 of a second abutting end 161. In some embodiments, a plurality of protrusions 4000 and sockets 159 may be used. In other embodiments, the protrusion 4000 may comprise a pointed shape, a conical shape, a curved shaped, a rectangular shape, a pyramidal shape, or combinations thereof and the socket 159 matches the profile of the protrusion.

This feature may be incorporated to further ensure that the segments 103 do not rotate within the first bore 101 as a result of exposure to high temperatures and high pressures. This feature may prove especially useful if the present invention is adapted for use in the application of a gun barrel where movement of the segments may detrimentally affect the trajectory of a bullet as it exits the barrel but may be significantly reduced if interlocking abutting ends are incorporated. The interlocking profiles may help align the rifling formed in the interior surface 104 of the second bore 102 if the rifling is formed prior to connecting the segments 103.

Figure 10:
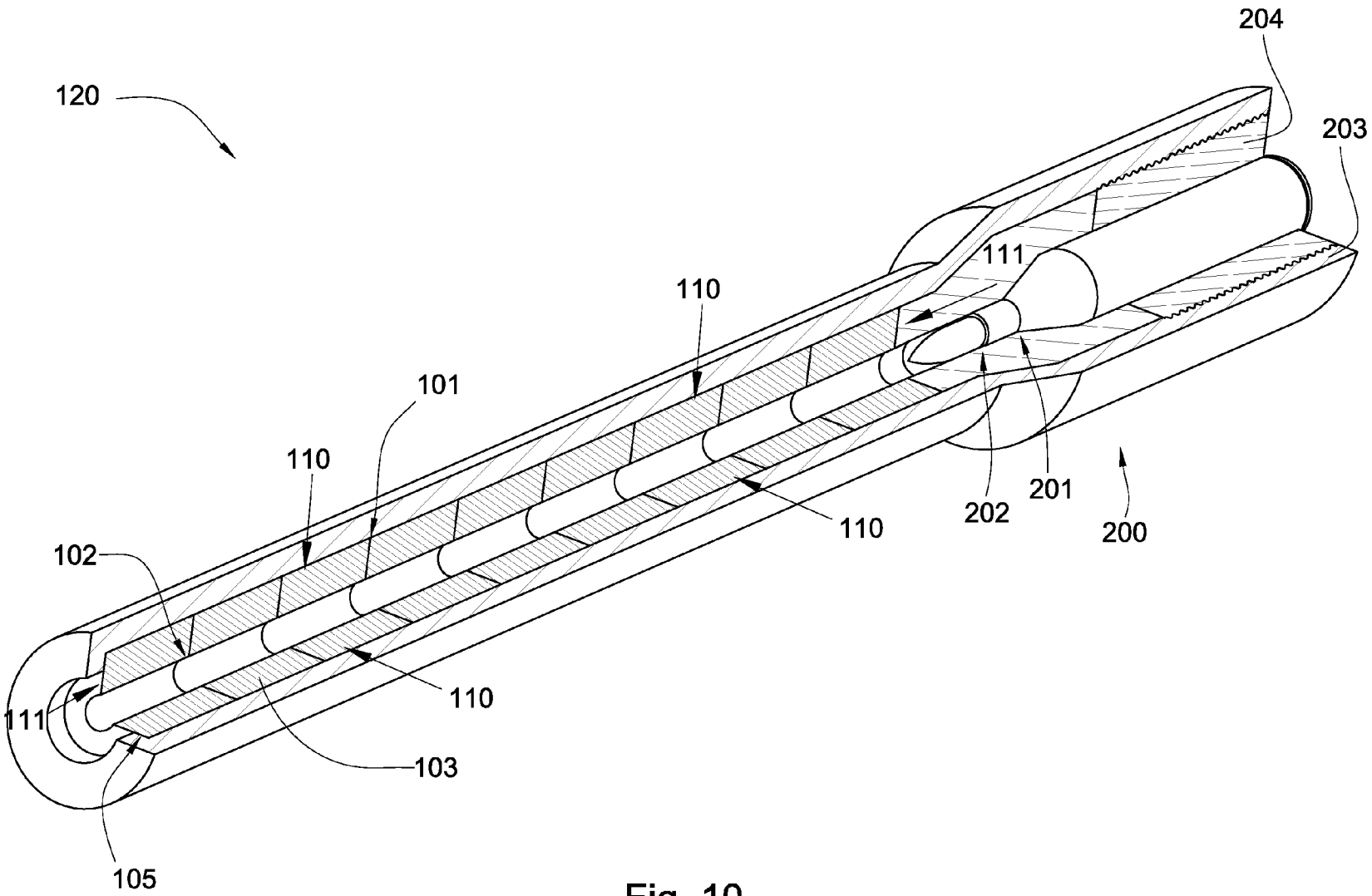
FIG. 10 is a perspective sectional diagram of another embodiment as a rigid composite structure.

FIG. 10 is a diagram of another embodiment of a rigid composite structure adapted for use as a gun barrel 120, constructed in accordance with this invention. While this invention may be described in connection with a gun barrel it should be noted that it is not restricted to this use and has multiple applications in any formation or construction as a rigid composite structure that retains its structural integrity during periods of high temperatures and high pressures. Other such structures may include piston cylinders, tubes or pipe. A gun barrel 120 may comprise of a first bore 101 formed in a metallic material such as steel. A second bore 102 formed in super hard geometric segments 103, those preferably being made of polycrystalline diamond, may be disposed within the first bore 101. The segments may be held under radial compression, as depicted by arrows 110, by the first bore 101 and axial compression, as depicted by arrows 111, by the shoulder end 105 and the breech component 200. A throat 201 and free bore 202 may be made of a metallic material as well as a breech end 203, which may be conveniently threaded for reception into a breech receiver 204. The breech receiver may apply the axial pressure. In some embodiments the exit end of the structure may be adapted to receive another threaded receiver which cooperates with the breech receiver to apply the axial compression to the segments.

Figure 11:
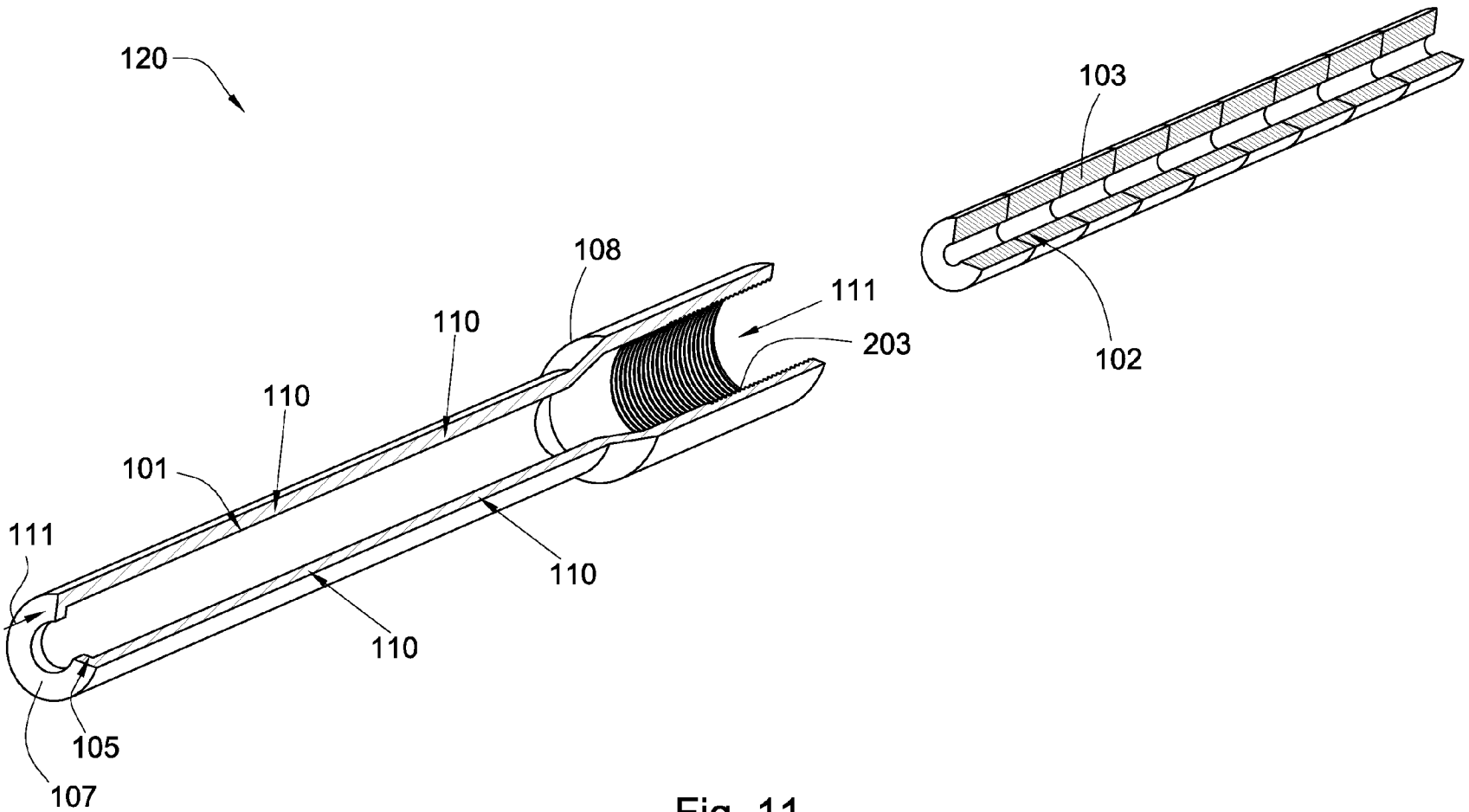
FIG. 11 is an exploded diagram of another embodiment as a rigid composite structure.

FIG. 11 is an exploded diagram of the aforementioned embodiment in FIG. 9 as a gun barrel 120. In some embodiments, the metallic material will be thermally expanded such that the segments may be inserted into the first bore 101 as a single unit. In other embodiments, the segments 103 may be aligned within the first bore 101. Invar 365 may be an ideal metallic material since it may expand significantly under very high temperatures which would allow the first bore 101 to be expanded for insertion of the segments, but Invar 365 may not significantly expand under the range of temperatures that the interior surface 104 of the second bore 102 will be exposed to under rapid gun fire allowing the first bore 101 to maintain radial compression 110 on the segments. After the segments 103 are inserted into the first bore 101, the temperature of the segments 103 may be lowered to shrink the metallic material. In some embodiments, the intermediate material may be wrapped around the segments prior to their insertion into the first bore.

In some embodiments, the breech receiver 204 will be threaded into place in the breech end 203 after the metallic material is sufficiently cooled. In other embodiments, the breech receiver 204 is not threaded, but is placed within the first bore 101 such that it biases the segments against the shoulder 105 of the first end 107, thereby applying an axial compression 111. Then the temperature of the metallic material is lowered, shrinking itself around the breech receiver 204 such that the receiver is held in place after cooling and continues to apply axial compression 111 to the segments. In yet other embodiments, axial pressure 111 may be applied by a biasing unit 108 while the first bore 101 is expanded and the biasing unit 108 is then removed after the metallic material is shrunk and the friction between the metallic material and the segments is enough to provide the axial compression 111.

Figure 12:
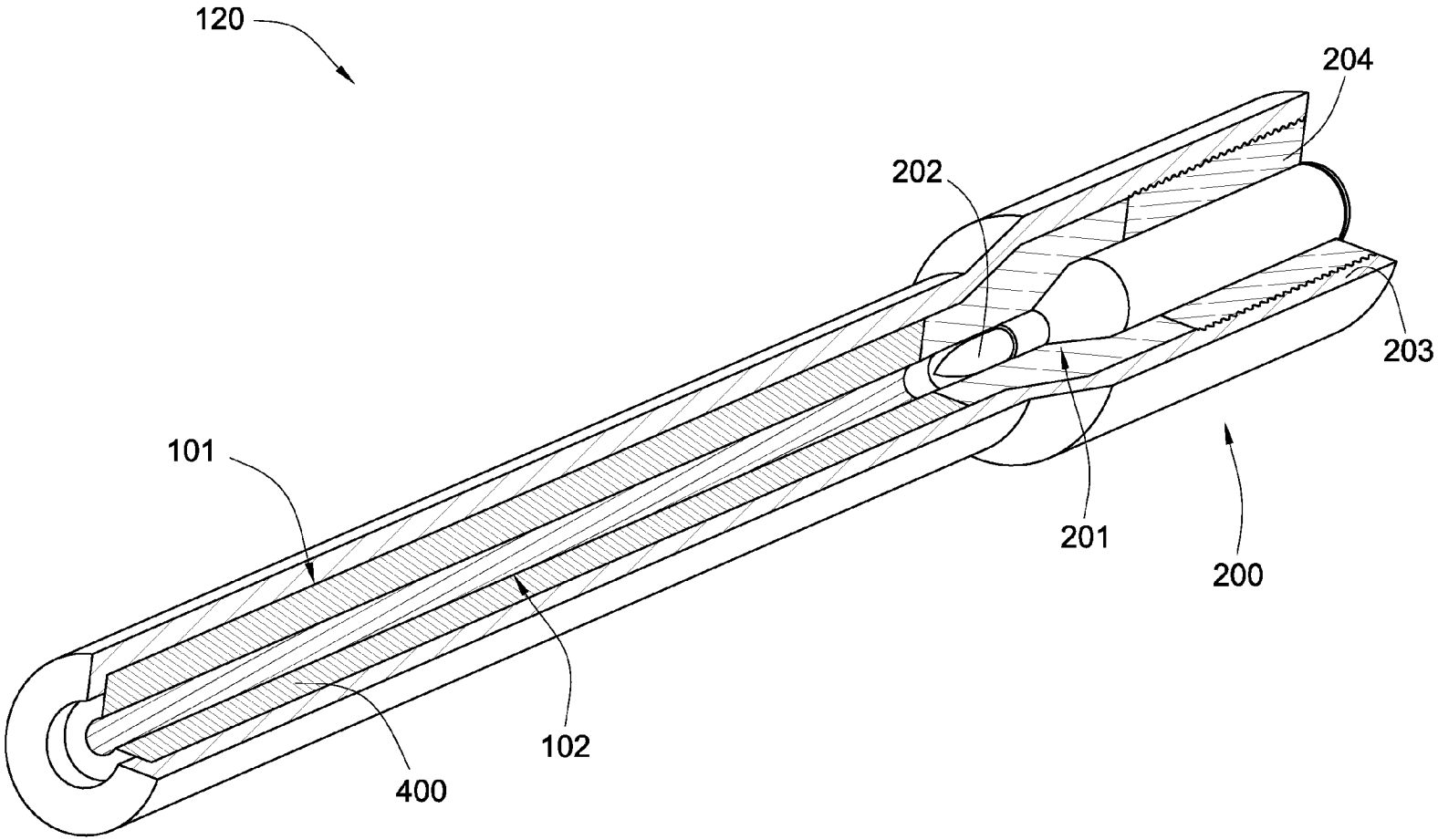
FIG. 12 is a perspective sectional diagram of another embodiment depicting a single super hard segment.

FIG. 12 is a diagram of another embodiment of the aforementioned application as a gun barrel 120 which may comprise a single super hard geometric segment 400. The breech component 200 of the structure may comprise a throat 201, free bore 202, a breech end 203, a breech receiver 204, or combinations thereof which may be made of a metallic material in whole or in part.

Figure 13:
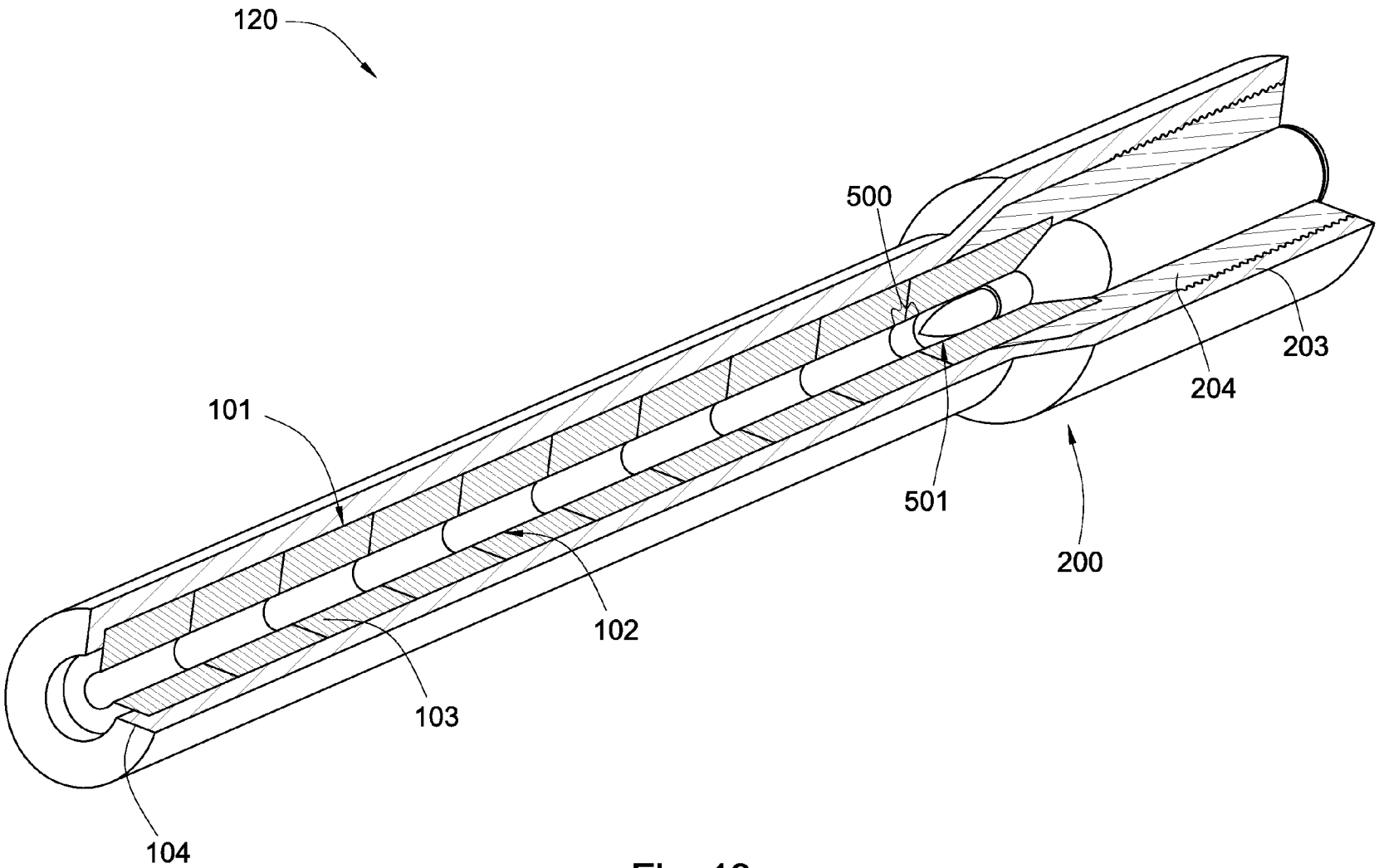
FIG. 13 is a perspective sectional diagram of another embodiment depicting a throat and free bore formed in a super hard composite material.

FIG. 13 is a diagram of another embodiment of the aforementioned application as a gun barrel 120 with a variation in the formation of the breech component 200 in which the throat 500 and free bore 501 are made of at least a portion of a super hard geometric segment 103. This may be advantageous since the throat 500 and the free bore 501 may be subjected to high amounts of wear.

Figure 14:
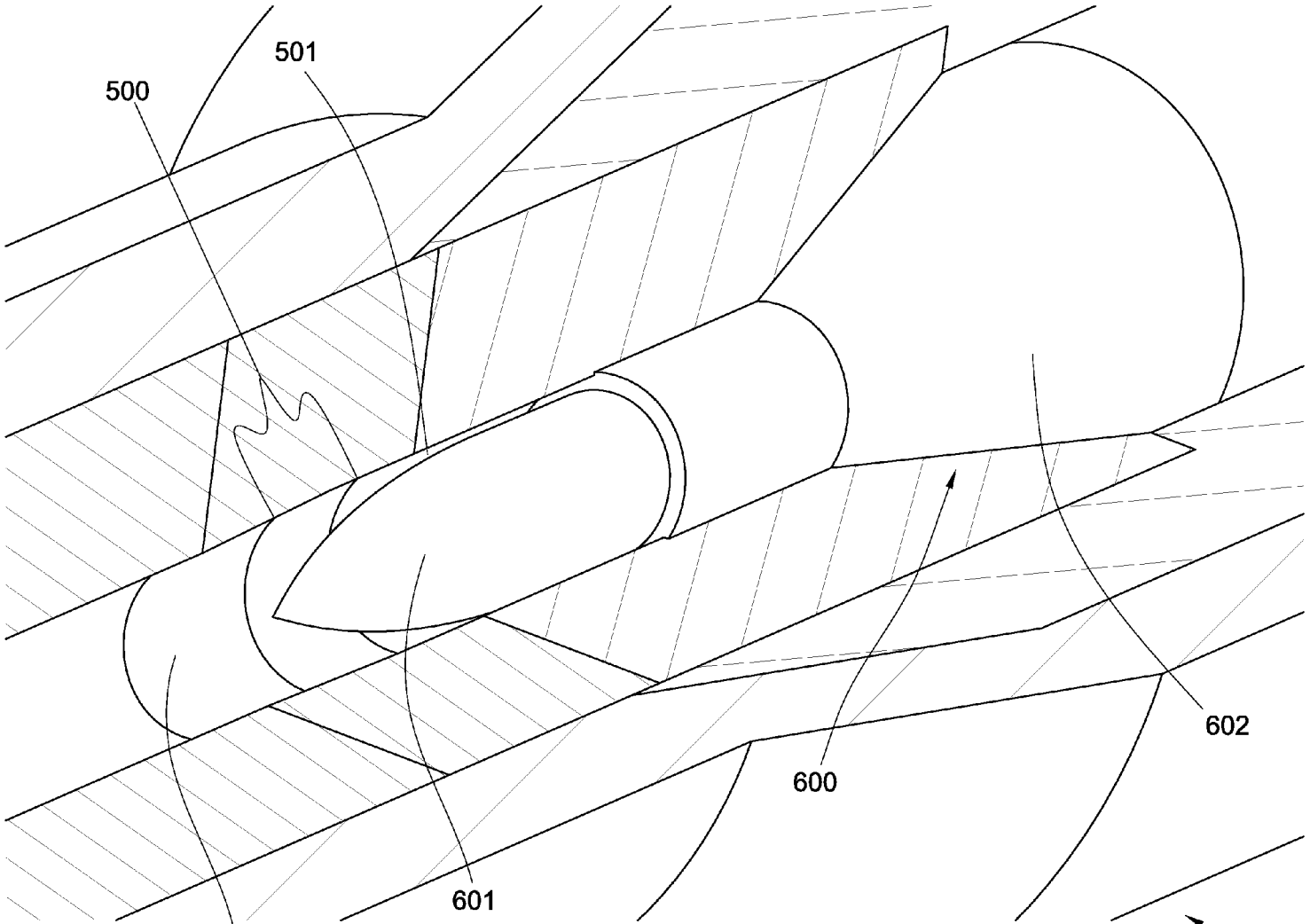
FIG. 14 is an enlarged view of another embodiment depicting a throat and free bore formed in a super hard composite material.

FIG. 14 is an enlarged view of the embodiment shown in FIG. 13 depicting a breech component 200 including the throat 500 which may be formed in the super hard interior surface 104. A shoulder 600 may serve to hold the cartridge 602 in place and from entering the barrel. In some embodiments, the cartridge 602 may be rimmed, rimless and straight bored, or rimless and necked. The diagram also depicts a throat 500 and free bore 501 formed in at least one of the super hard segments. The view depicts the throat 500 as it tapers in until the diameter is substantially equal with the rest of the interior surface 104 of the gun barrel. The throat may assist to guide the bullet 601 into the barrel.

Figure 15:
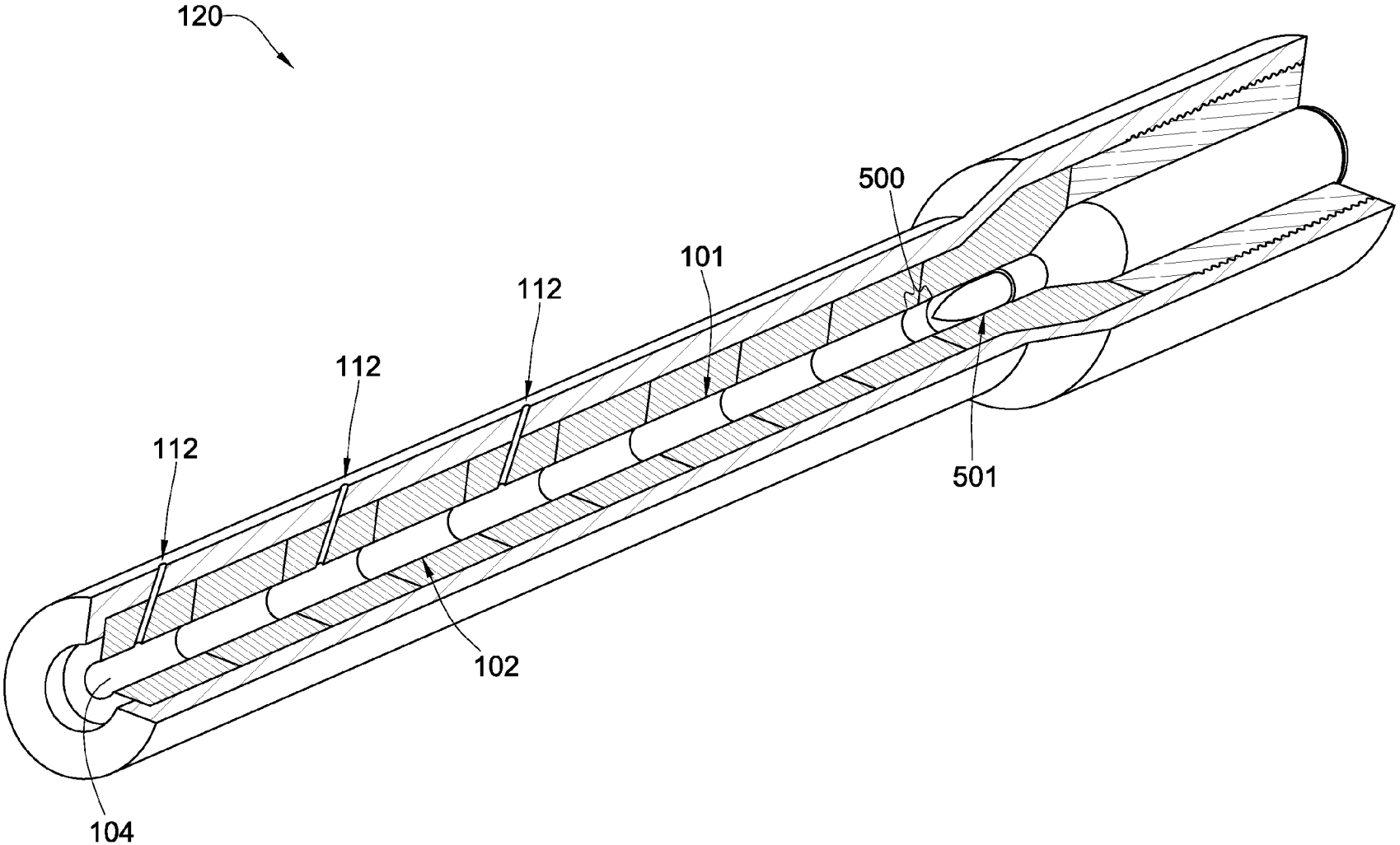
FIG. 15 is a perspective sectional diagram of another embodiment depicting a throat and free bore formed in a super hard composite material.

FIG. 15 is a diagram of another embodiment of the aforementioned application as a gun barrel 120 with a variation in the formation of a breech component 200 in which a throat 500 and free bore 501 may be entirely made of super hard composite materials.

The embodiment also depicts at least one port 112 through the metallic material and the super hard interior surface 104 which may help to counteract recoiling effects. The ports may comprise a variety of geometries such as straight bores, tapered bores, rectangular bores, curved bores, angled bores, or combinations thereof. The ports may comprise a port axis that is normal to the axis of the composite structure or the port access may intersect the axis of the composite structure at any angle.

Figure 16:
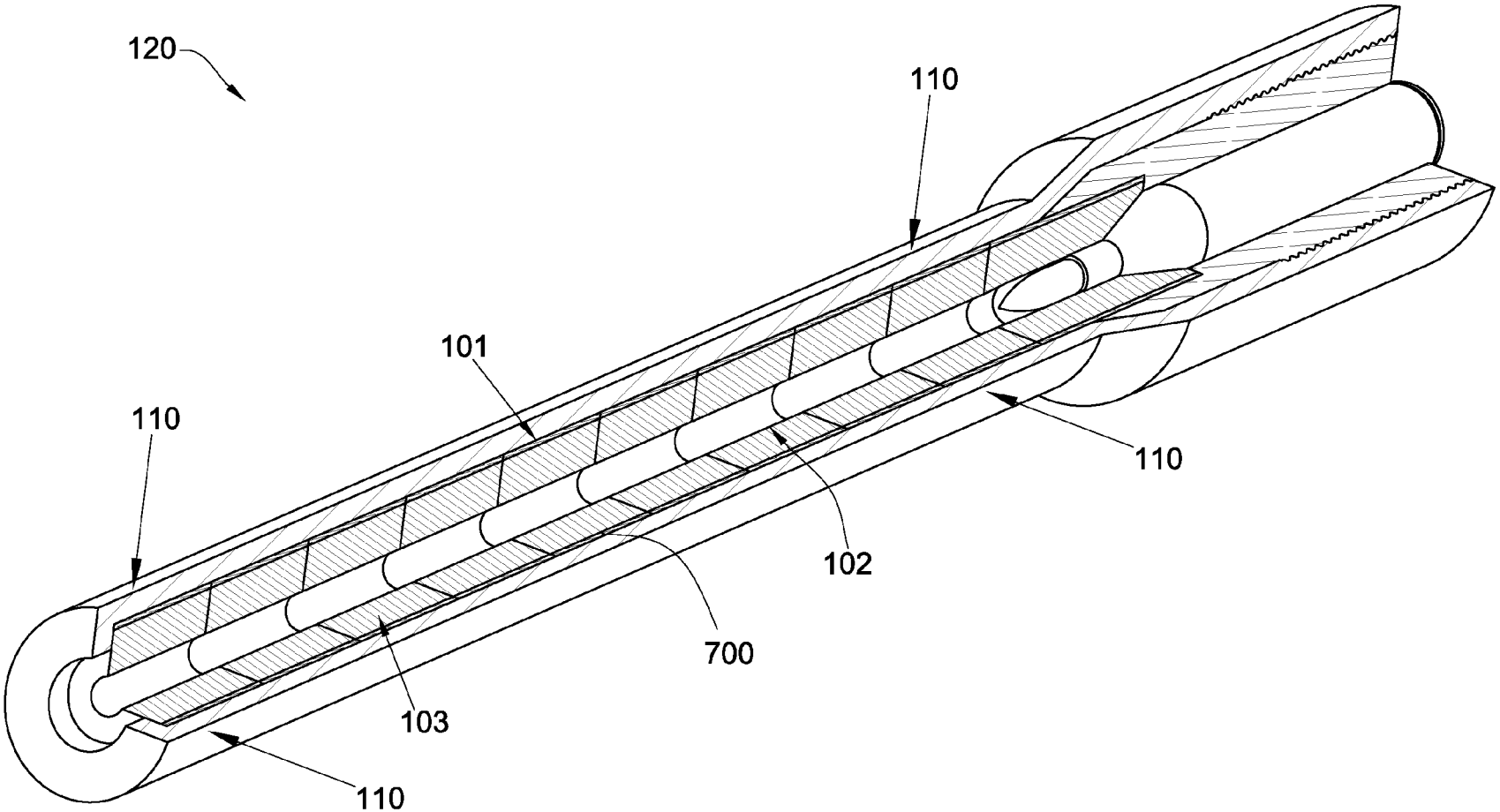
FIG. 16 is a perspective sectional diagram of another embodiment depicting an intermediate layer.

FIG. 16 is a diagram of another embodiment of the aforementioned application as a gun barrel 120. This embodiment may comprise of an additional intermediate layer 700 which may comprise of a material with a low thermal expansion rate such as Invar 36, Invar 42, and Invar 365, a composite, a ceramic, a refractory metal, carbon fiber or combinations thereof.

The intermediate layer 700 may be wrapped between the metallic material and the super hard geometric segments 103 and serve as a thermal insulator to further enhance the structural integrity of the structure by assisting to contain the detrimental effects of heat on the structure. A thermal insulator may be advantageous in embodiments, where the metallic material would thermally expand within a temperature produced during gun fire and help prevent heat from reaching the metallic material and allow the radial compression 110 on the segments to be maintained. Further, an intermediate layer 700 with a low co-efficient of thermal expansion may also be used as the intermediate material. In such an embodiment, the intermediate layer 700 may comprise a high or low thermal conduction rate, but since the intermediate layer 700 may not expand even if the metallic material does, the radial compression 110 may be maintained. Also, the thermal conductivity of a superhard segment made of diamond or cubic boron nitride is much higher than standard steels typically used for gun barrels. The friction of the bullet traveling down the barrel may be lower allowing higher velocities.

Figure 17:
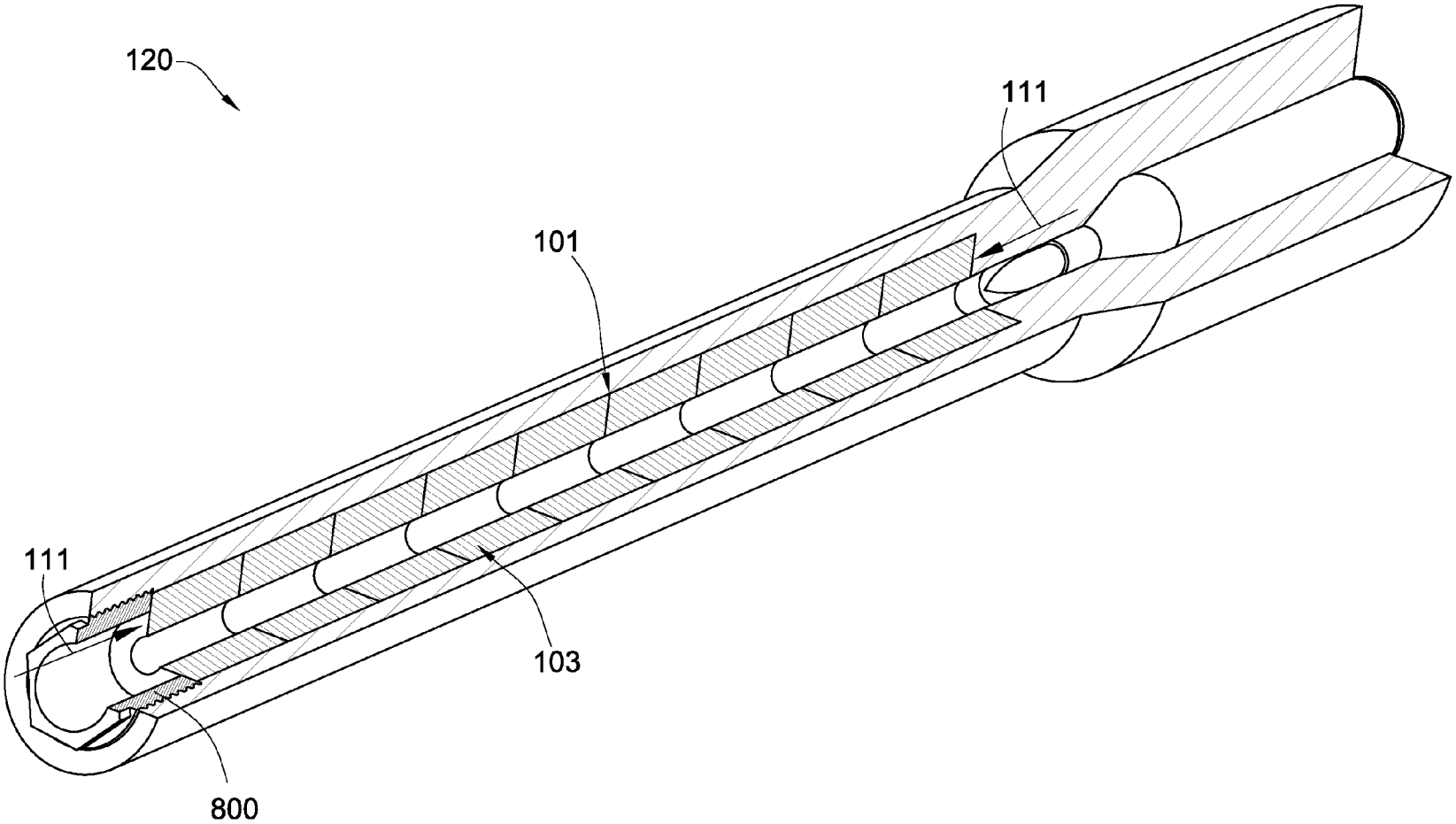
FIG. 17 is a perspective sectional diagram of another embodiment depicting a threaded receiver.

FIG. 17 is a diagram of another embodiment of the aforementioned application as a gun barrel 120. This embodiment may comprise a threaded receiver 800 which may be comprise a material selected from the group consisting of aluminum, titanium, a refractory metal, steel, stainless steel, Invar 36, Invar 42, Invar 365, a composite, a ceramic, carbon fiber and combinations thereof at the first end of the first bore 101 which may serve to hold the super hard geometric segments 103 in place and apply axial compression 111.

Figure 18:
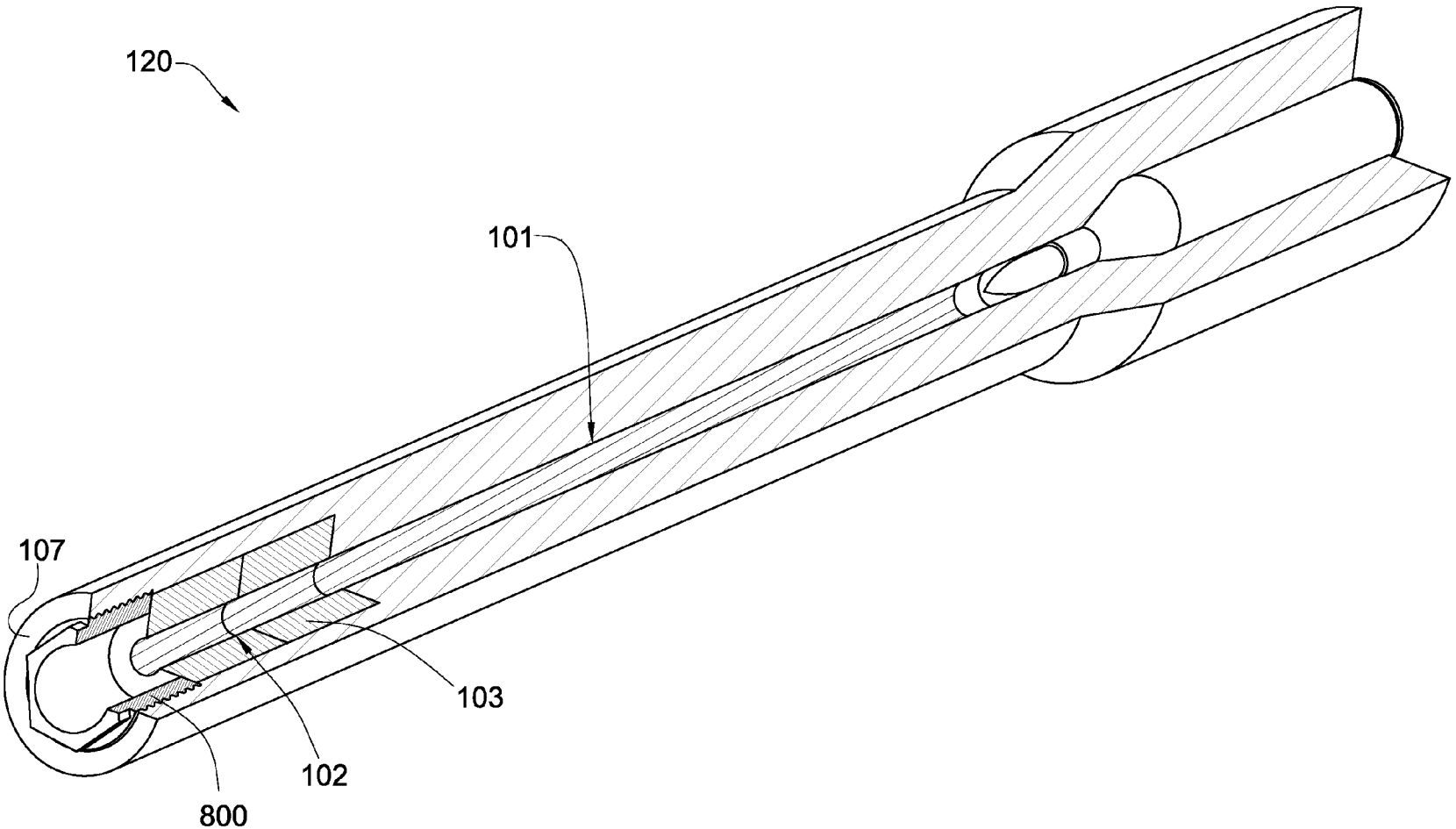
FIG. 18 is a perspective sectional diagram of another embodiment depicting a portion of composite material with a threaded receiver.

FIG. 18 is a diagram of another embodiment of the aforementioned application as a gun barrel 120. This embodiment may comprise of a first bore 101 that only a portion of which is lined with super hard geometric segments 103 while still incorporating the threaded receiver 800 depicted in FIG. 17 at the first end 107 of first bore 101. The threaded receiver 800 may bias the segment or segments against an internal shoulder formed in the first bore. Placing the super hard segments at the near the exit end of the barrel may be advantageous since gun barrels are subjected to a high amount of wear near its first end 107.

Figure 19:
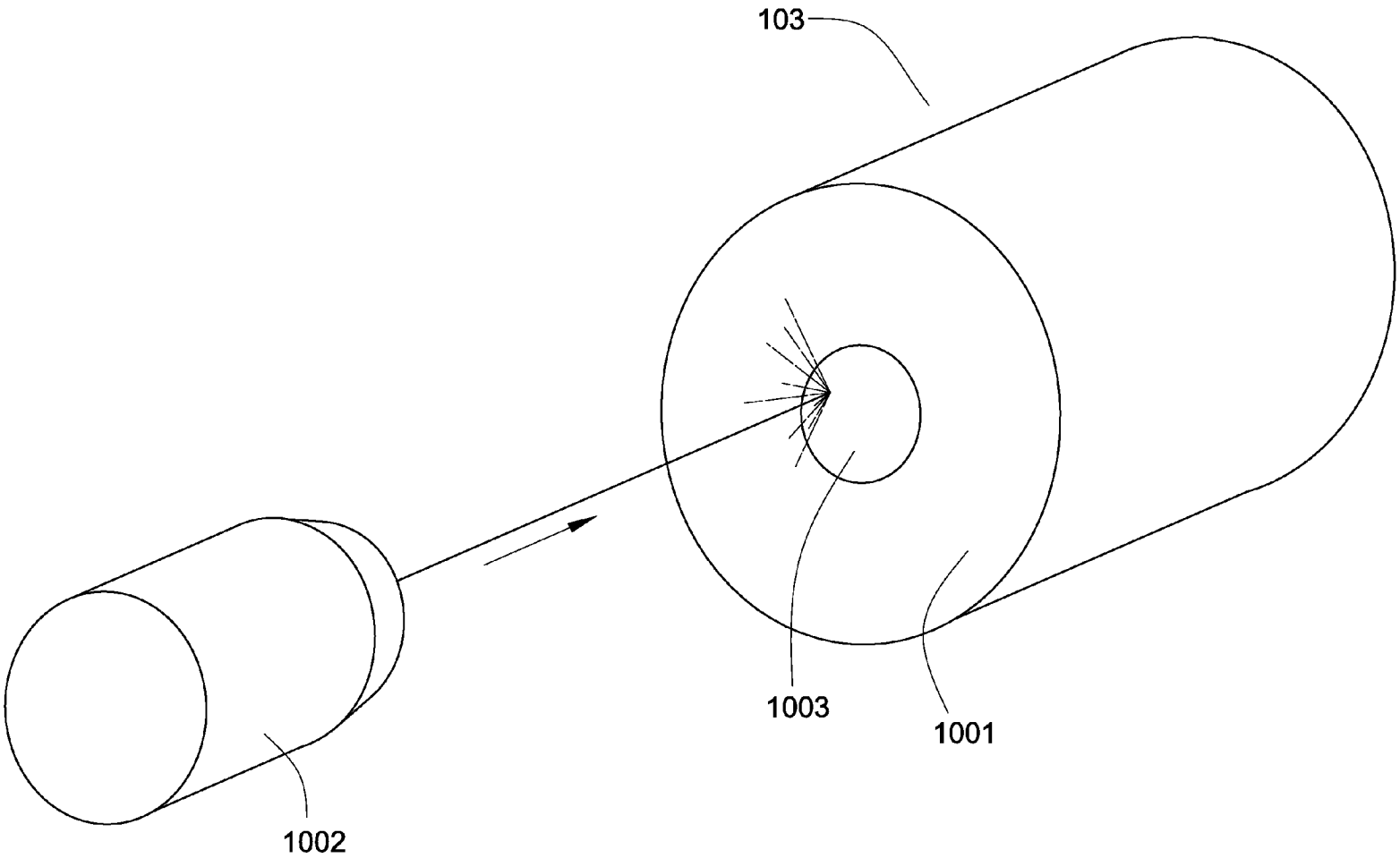
FIG. 19 is a perspective diagram of another embodiment depicting a method of subjecting a composite segment to the electrode of an electric discharged machine (EDM).
Figure 20:
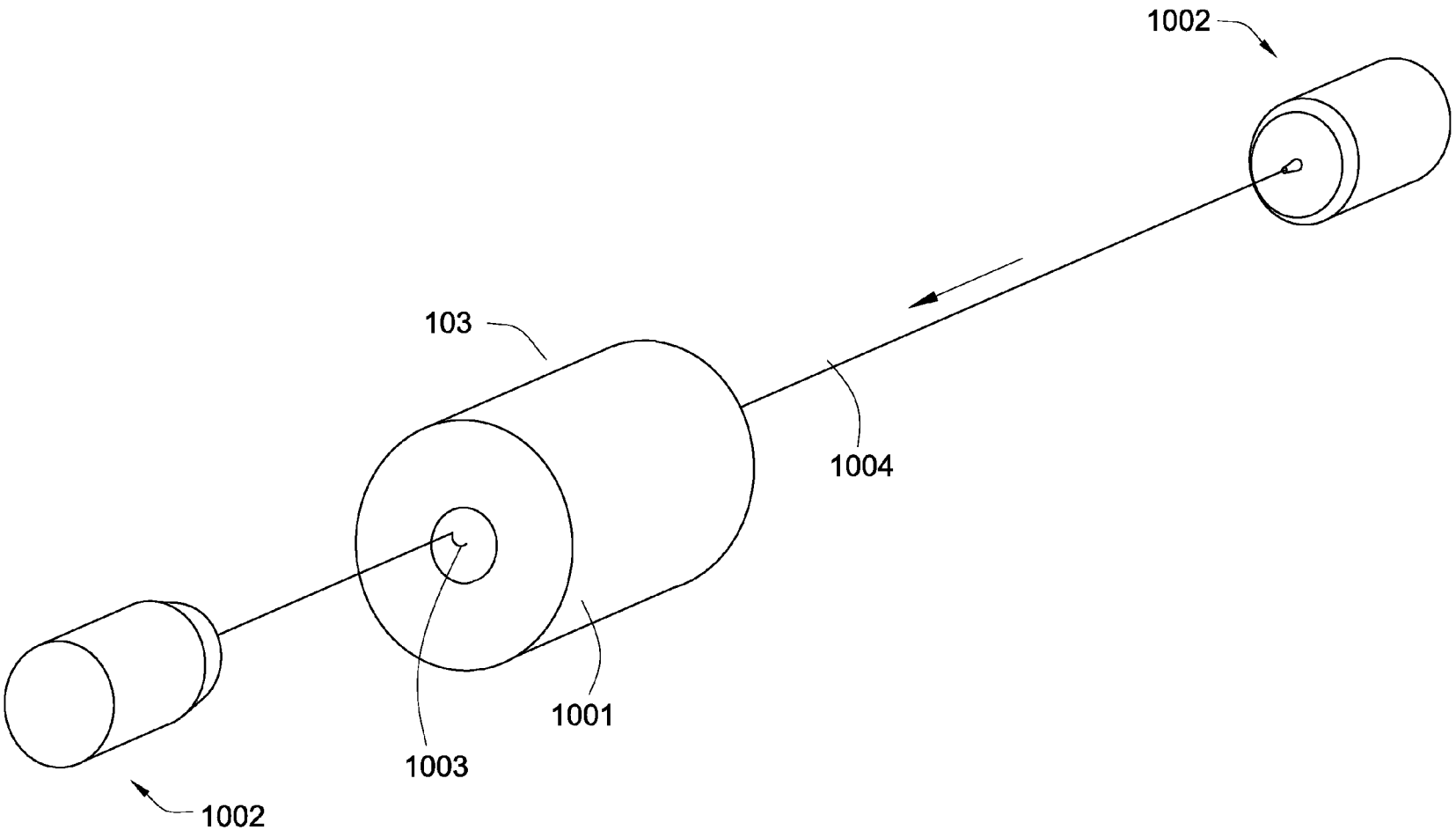
FIG. 20 is a perspective diagram of another embodiment depicting a method of cutting a composite segment using an EDM wire.

FIGS. 19 and 20 are diagrams of other embodiments of the current invention depicting a method of manufacturing the super hard geometric segments 103. In such an embodiments, the segments 103 of the super hard composite material (preferable made of polycrystalline diamond) may be formed in a high temperature and high pressure press. The diamond grains are positioned within the press around a pillar 1003 of tungsten carbide which helps to mold the diamond segment in an annular shape. A binder may diffuse from the tungsten carbide into the diamond grains and act as a catalyst. After the solid segment has been formed, the method may further comprise the use of an electrical discharge machine (EDM). An electrode 1002 of the EDM may be plunged into the solid segment of super hard composite material 1001 to form a cavity which results in the formation of the interior surface. Preferably, as shown in FIG. 20 after the cavity is initially formed by the EDM from one end of the solid segment to the other end, an EDM wire 1004 may be threaded through the cavity. This may be beneficial since particles of the super hard material are attracted to the EDM wire or electrode and may be removed from the segment by pulling the wire through the cavity. Preferably, all of the tungsten carbide is removed such that there is substantially no tungsten carbide remaining in the superhard interior surface 104 of the segment 103. In other embodiment, a geometry of the superhard segments may be formed by abrasive lapping and/or abrasive grinding.

In some embodiments, the pillar may be lined with a high concentration of binder. In other embodiments a foil, such as a cobalt foil, may be wrapped around the pillar which may help in the diffusion of the binder into the diamond grains. In yet other embodiments a foil may be placed between the diamond grains and the pillar to prevent a creation of a strong bond between the two. Still in some embodiments, the pillar may be made of salt or the pillar may be lined with salt. A salt pillar with a foil of a desired binder wrapped around it may allow the formation of a strong annular segment with an easily removable pillar.

Figure 21:
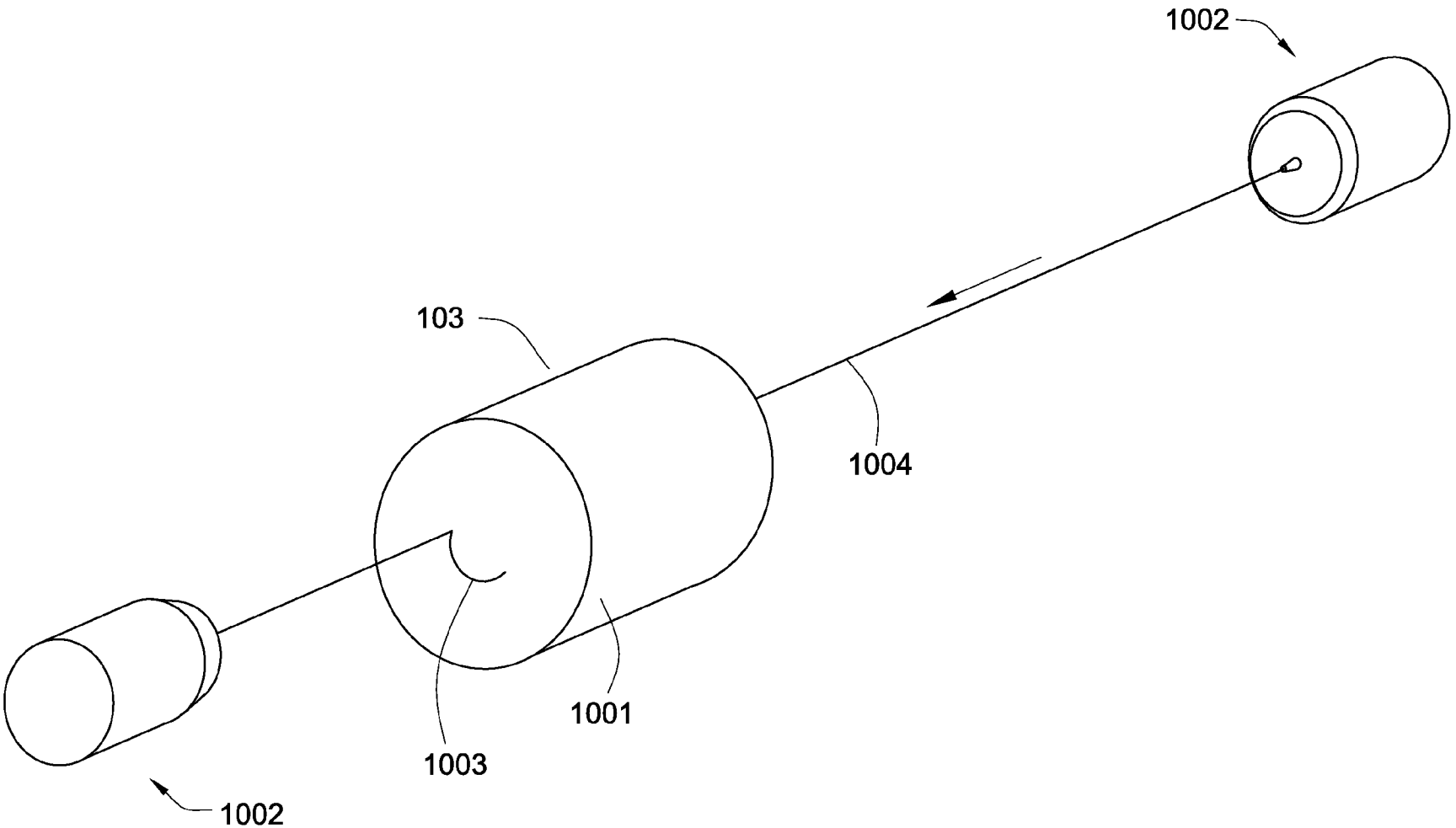
FIG. 21 is a perspective diagram of another embodiment depicting a method of cutting a solid composite segment using an EDM wire.

FIG. 21 is a diagram of another embodiment of the current invention. It differs from FIG. 20 in that the depicted segment 103 is solid and has no pillar of another material disposed within it.

Figure 22:
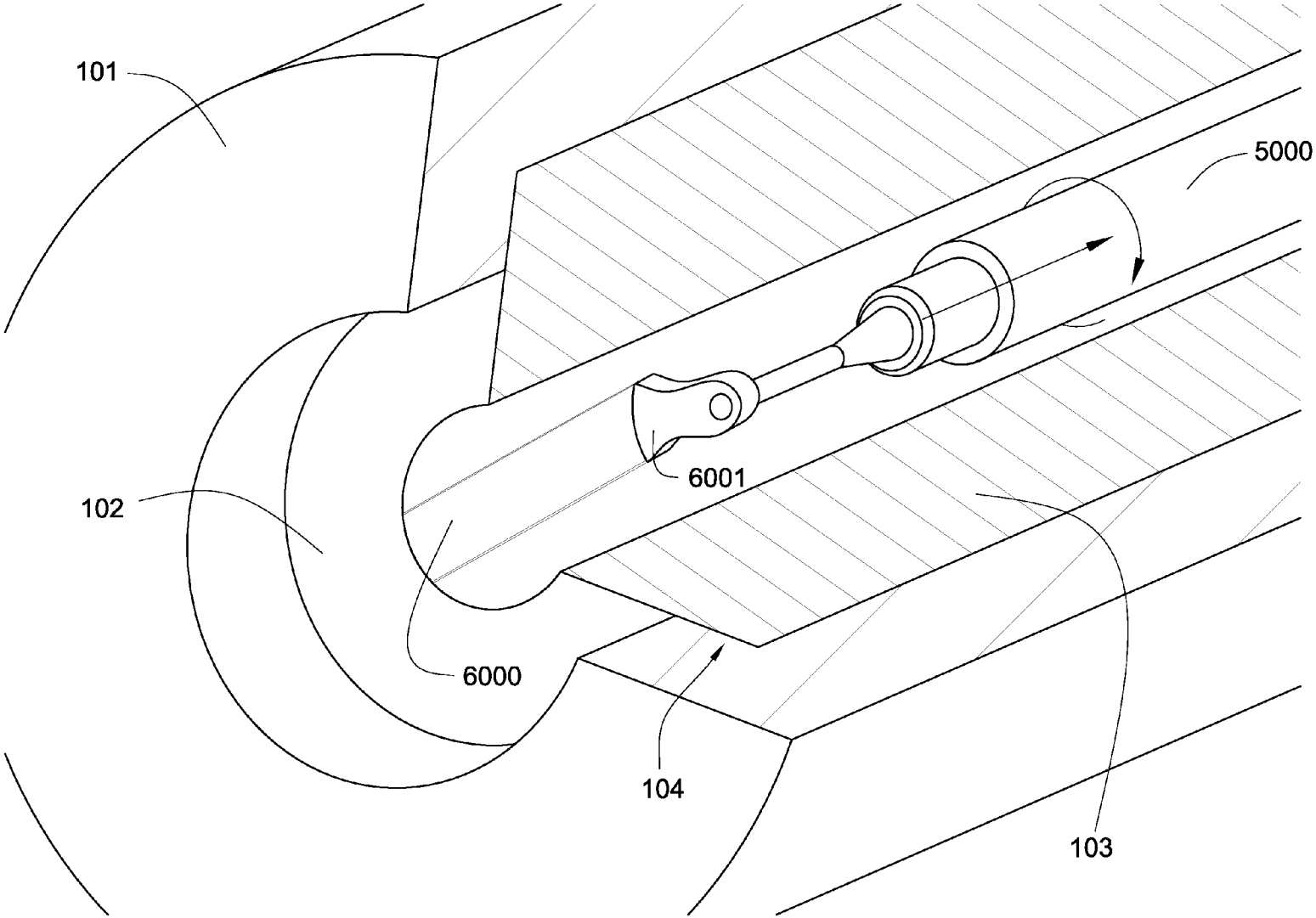
FIG. 22 is a perspective sectional diagram of another embodiment depicting a method of forming a pattern in super hard segments using an EDM.
Figure 23:
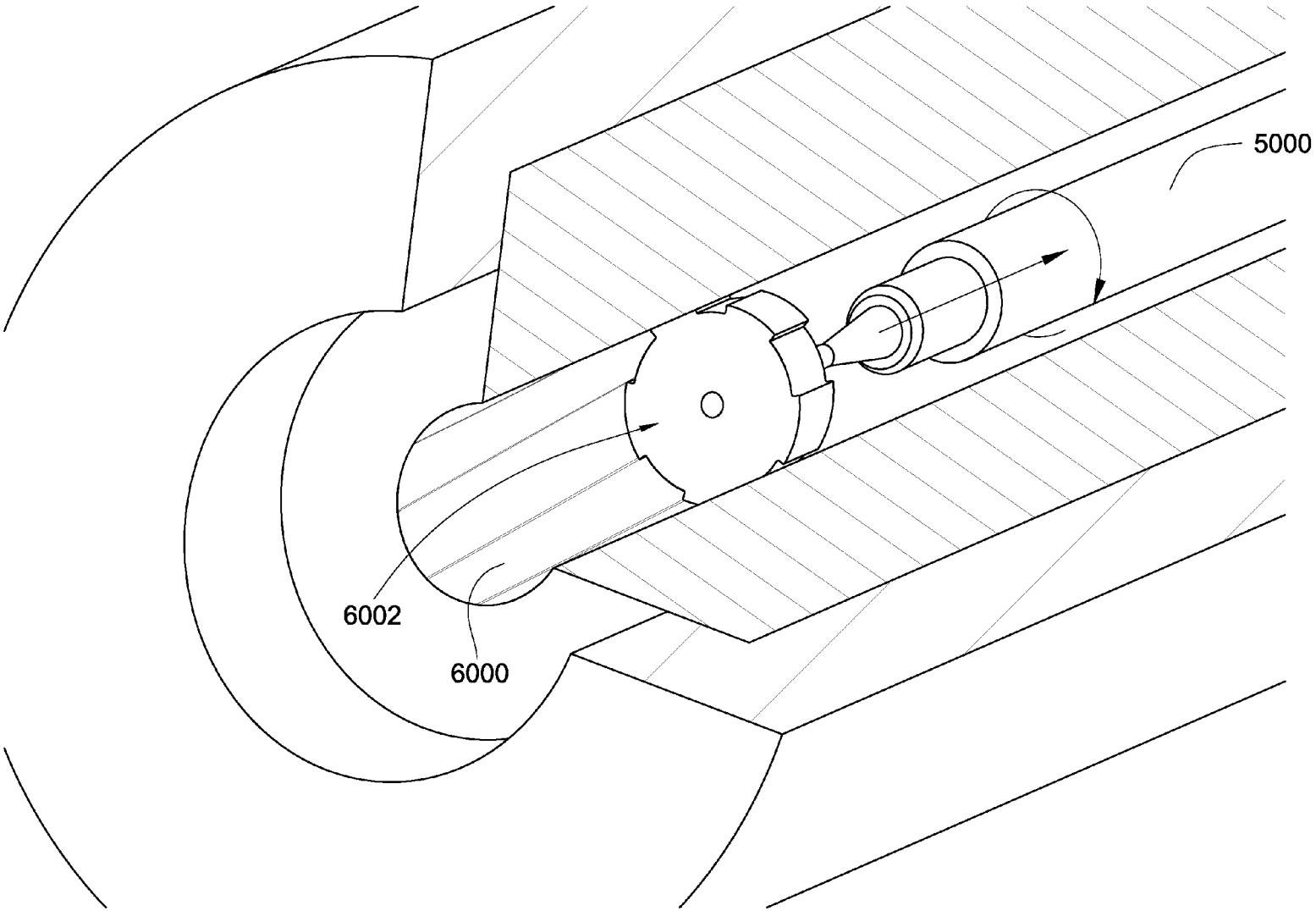
FIG. 23 is a perspective sectional diagram of another embodiment depicting another method of forming a pattern in super hard segments using an EDM.

FIGS. 22 and 23 are similar diagrams of embodiments of the aforementioned application as a gun barrel 120 depicting a rifling process that may be incorporated using an EDM bit 5000 that is moved through the barrel and twisted either clockwise or counter-clockwise to form the desired rifling pattern 6000 using various cutting faces 6001 and/or 6002.

Figure 24:
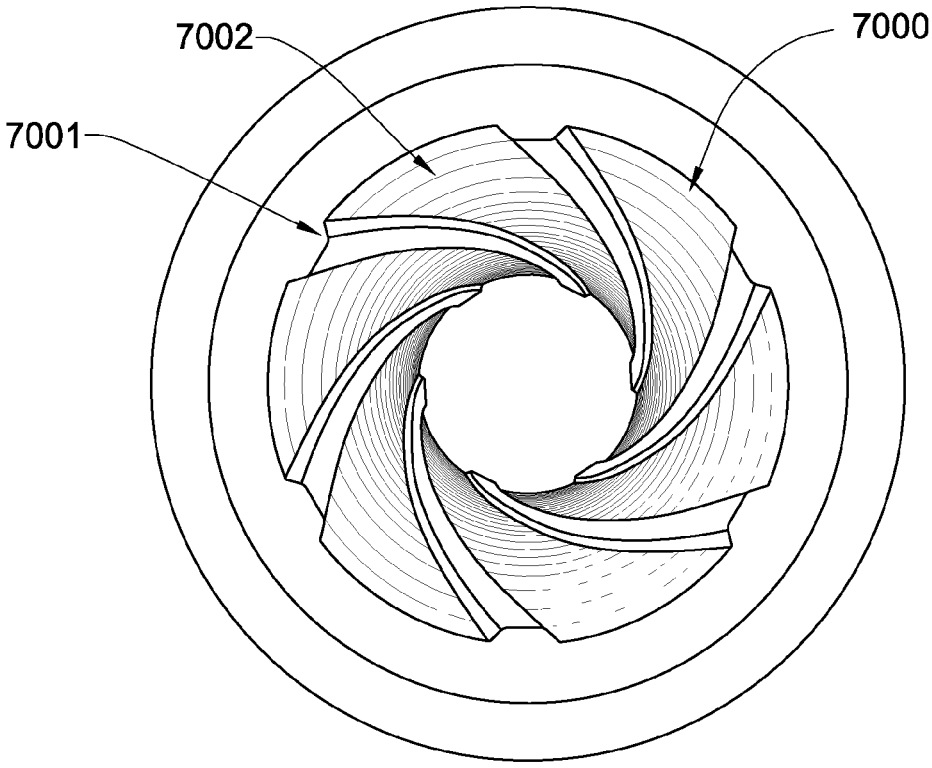
FIG. 24 is a perspective diagram of another embodiment depicting a land and groove rifling pattern.
Figure 25:
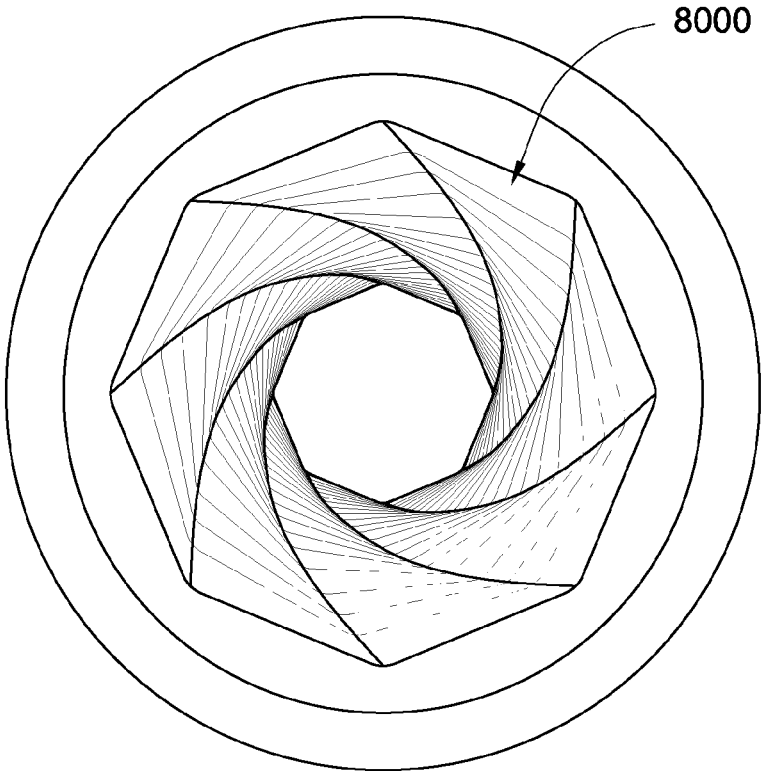
FIG. 25 is a perspective diagram of another embodiment depicting a polygonal rifling pattern.

FIGS. 24 and 25 disclose other embodiments of the aforementioned application as a gun barrel 120 which depict a first and a second rifling pattern 7000, 8000. The first pattern 7000 comprises lands 7001 and grooves 7002 formed in the interior surface of the segments. The second pattern comprises a polygonal shape. Both of these patterns may be formed with the aforementioned EDM. The rifling patterns may be incorporated to assist with the ballistics of a gun barrel as the bullet exits the barrel during ordinance use.

Patterns formed in the interior of other composite structures may also be formed using an EDM. It may be desirable that a piston comprise an anti-rotation protrusion and super hard segments lining the bore of the cylinder comprises a complementary slot coaxial with the piston for the protrusion to travel in.

Figure 26:
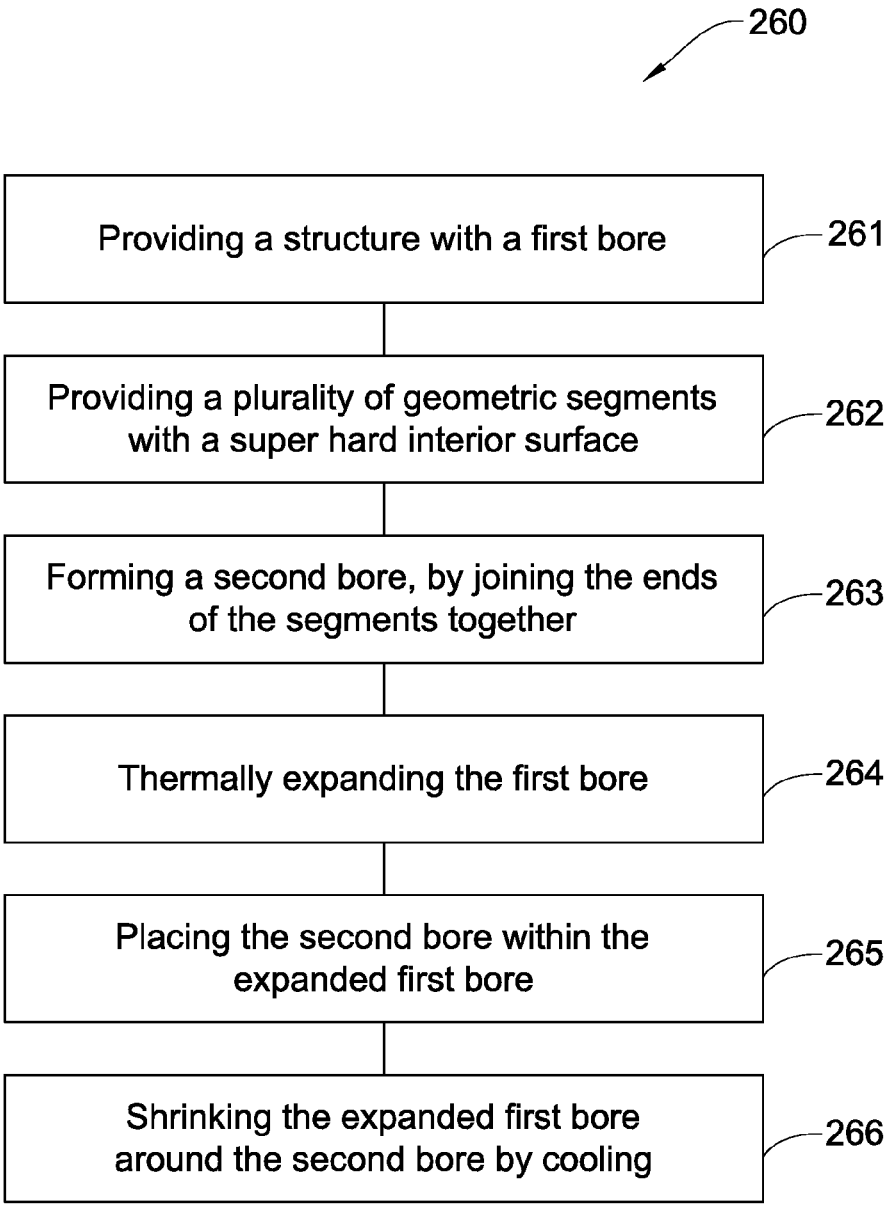
FIG. 26 is a flowchart illustrating a representative method for making the rigid composite structure.

FIG. 26 is a diagram depicting a method 260 for manufacturing a rigid composite structure. The method comprises the steps of providing 261 a structure with a bore, providing 262 a plurality of geometric segments with a superhard interior surface, forming 263 a second bore by joining the ends of the segments together, thermally expanding 264 the first bore, placing 265 the second bore within the expanded first bore, and shrinking 266 the first bore around the second bore by cooling.

Whereas the present invention has been described in particular relation to the drawings attached hereto, it should be understood that other and further modifications apart from those shown or suggested herein, may be made within the scope and spirit of the present invention.

What is claimed is:

1. A rigid composite structure, comprising:

a bore formed in a metallic material and comprising a longitudinal axis;

a tubular body formed by geometric segments comprising a superhard interior surface wherein the superhard interior surface comprises a material selected from the group consisting of natural diamond, synthetic diamond, polycrystalline diamond, single crystalline diamond, cubic boron nitride, and composites thereof with a binder, the segments being disposed adjacent one another substantially co-axial along the longitudinal axis within at least a portion of the bore; and the superhard interior surface is under a radial and axial compression;

wherein the superhard interior surface comprises a geometry formed by electrical discharge machining; and the superhard interior surface comprises a region extending radially from the interior surface throughout the entire tubular body that is depleted of a binder material.

2. The structure of claim 1, wherein the superhard interior surface comprises a binder material selected from the group consisting of cobalt, niobium, titanium, zirconium, nickel, iron, tungsten, tantalum, molybdenum, silicon, a refractory group metal, or combinations thereof.

3. The structure of claim 1, wherein the metallic material comprises a material selected from the group consisting of aluminum, titanium, a refractory metal, steel, stainless steel, a composite, a ceramic, carbon fiber or combinations thereof.

4. The structure of claim 1, wherein the superhard interior surface is made of a plurality of grains comprising a size of 0.1 to 300 microns.

5. The structure of claim 1, wherein the radial compression is achieved by heat shrinking the metallic material around the superhard interior surface.

6. The structure of claim 1, wherein the axial compression is achieved by providing a shoulder in a first end of the bore and a biasing unit in a second end of the bore.

7. The structure of claim 1, wherein the superhard interior surface comprises a thermal expansion coefficient of 0.5 to 10 μin/in.

8. The structure of claim 1, further comprising a port through the metallic material and the tubular body.

9. The structure of claim 1, wherein the metallic material is a piston cylinder, a gun barrel, a tube and/or a pipe.

10. The structure of claim 1, wherein a free bore is formed in the superhard interior surface.

11. The structure of claim 1, wherein a throat is formed in the superhard interior surface.

* * * * *